US006113461A

United States Patent [19]

Onoda et al.

[11] Patent Number: 6,113,461

[45] Date of Patent: Sep. 5, 2000

[54] GRINDING METHOD UTILIZING GRINDING SHARPNESS OF GRINDING ELEMENT

[75] Inventors: Makoto Onoda, Iwata; Masatoshi Ichikawa, Hamamatsu; Takehiro Ohashi; Shinji Kuwahara, both of Iwata; Takahiro Nakano, Hamamatsu; Yuzo Hotta, Iwata, all of Japan

[73] Assignee: NTN Corporation, Osaka, Japan

[21] Appl. No.: 08/936,814

[22] Filed: Sep. 24, 1997

[30] Foreign Application Priority Data

| | | | |
|---|---|---|---|
| Sep. 30, 1996 | [JP] | Japan | 8-280115 |
| Oct. 22, 1996 | [JP] | Japan | 8-299426 |
| Oct. 22, 1996 | [JP] | Japan | 8-299427 |
| Oct. 25, 1996 | [JP] | Japan | 8-301271 |

[51] Int. Cl.[7] ..... B24B 49/00; B24B 51/00

[52] U.S. Cl. ..... 451/5; 451/8; 451/52; 451/53; 451/57; 451/61

[58] Field of Search ..... 451/5, 8, 21, 53, 451/22, 51, 52, 61, 57, 69

[56] References Cited

U.S. PATENT DOCUMENTS 3,822,516 7/1974 Huber .
5,129,188 7/1992 Alverio .
5,405,285 4/1995 Hirano et al. .
5,439,330 8/1995 Bayer et al. .

*Primary Examiner*—Timothy V. Eley
*Attorney, Agent, or Firm*—Birch, Stewart, Kolasch & Birch, LLP

[57] ABSTRACT

In order to eliminate a delay in a driving system and a control system during sequential operation of various component parts, to thereby realize a high speed and easy multi-axis control, a work delivery and removing device (7), a grindstone retracting device (14) and a gauge retracting device (19) are driven by respective compact electric motors (15, 13, 18) through associated reduction gear units. A reference pulse generator (34) for sequencers for generating reference pulses is provided, which reference pulses are distributed by a pulse distributor (35) to various position change curve setting units (36A, 36B, 36C). The position change curve setting units (36A, 36B, 36C) are a so-called electronic cam and output in response to receipt of the corresponding reference pulses respective position commands representative of predetermined position change curves (a, b, c). Servo-controllers (37A, 37B, 37C) are used for controlling the electric motors (15, 13, 18) in response to these outputs.

16 Claims, 16 Drawing Sheets

SEQUENCE DIAGRAM OF GRINDER MECHANICAL OPERATIONS

Pror Art

Pror Art

GRINDING METHOD UTILIZING GRINDING SHARPNESS OF GRINDING ELEMENT

BACKGROUND OF THE INVENTION

1. Field of the Invention

The present invention relates to a grinder such as, for example, an internal grinding machine, an cylindrical grinder or a centerless grinder, and a grinding machine such as, for example, a superfinishing machine and, more particularly, to a control device in an automatic shoe-supported milling machine, an improvement in a work exchanger and stabilization of the processing accuracy.

The present invention also relates to a grinding method and a grinding machine, in which the change in processing efficiency of a grindstone (a so-called "grindstone sharpness") resulting from wear of the grindstone is determined during the process and the subsequent milling is controlled according to the determined grindstone sharpness and, more particularly, to the grinding method and the grinding machine which are effectively utilized where the cycle time of the grinding process is short.

The present invention furthermore relates to a grinding method and a grinding machine, in which in the grinding machine of a type having a processing system of a low rigidity, such as an internal grinder, or the grinding machine of a type having a work of a low rigidity and a support system of a low rigidity, the depth of cut is set back to release deflection subsequent to a rough processing in the event of the deflection increasing as a result of a processing force. In particular, the present invention relates to a grinding method and a grinding machine which are effectively utilized where a number of identical works are successively machined.

The present invention relates to a grinding method and a grinding machine, wherein even in the presence of a change in machining allowance and also in grindstone sharpness (processing efficiency) during the final grinding process, the length of time during which the machining is carried out, that is, the machining time, can be controlled to a target value and the processing resistance is controlled to stabilize the processing accuracy.

2. Description of the Prior Art

As is well known to those skilled in the art, machine operations of grinding machines are sequentially controlled by the use of a sequencer. In such case, one machine operation is followed by the subsequent machine operation after completion of such one machine operation has been confirmed by means of an approach sensor or the like. The sequence of control of operation of the internal grinder is shown in FIG. 7 and a time chart thereof is shown in FIG. 8.

The prior art machine operation will be discussed with reference to FIGS. 7 and 8. After completion of the processing, the grindstone is retracted from a cutting position to a retracted position and a grindstone retraction sensor disposed at a position adjacent the retracted position is switched on. An electric signal issued by the grindstone retraction sensor is transmitted to a sequencer to cause the latter to issue a retraction command to retract a grindstone table. When the grindstone table subsequently depresses a table retraction affirm sensor disposed at a position adjacent a retracted position for the grindstone table, the sequencer affirms retraction of the grindstone table and then generates a gauge retraction signal. In the case of the internal grinder, when both of the grindstone and the gauge move out of the work, the loader is brought into operation to discharge the processed work so that a next succeeding work to be processed can be loaded.

Although the loader operates at the discharge position to replace the machined work with a next succeeding work to be machined, the actual loading of the next succeeding work to be machined takes place after arrival at the discharge position has been ascertained and the timer has subsequently timed up. Upon loading of the next succeeding work to be machined, the loading operation is ascertained by means of one or more sensors and the operation then takes place in the order of the gauge, the grindstone table and cutting which is reverse to the unloading. FIGS. 6A and 6B illustrate an exemplary loading apparatus. Actuators or accomplishing those sequential operations are generally employed in the form of hydraulic and/or pneumatic cylinders. Machine arrangement of the inner grinder is such as shown in FIG. 5.

Referring to FIG. 6A, the work W which has been processed is discharged by an unloading operation of a loader arm cylinder 51 and the work W within a pocket 53 defined in a loader arm 52 engaged therewith is moved to a placement position P. The work W which has already been processed is pushed by a next succeeding work W to be subsequently processed towards a stop device 54 at which the next succeeding work W is held still in contact therewith. At this time, in order to ascertain that the processed work W has been replaced with the next succeeding work W, the loader arm 52 is held inoperative by a timer subsequent to a confirmation by a sensor sd and until the next succeeding loading is initiated.

While there is available a machine in which the sequence from the cutting of the work to the placement thereof is carried out by separate mechanisms, the illustrated machine requires the use of separate sensors for actuating a placement mechanism and for ascertaining completion of the placement operation subsequent to confirmation done by the sensor sd.

Referring now to FIG. 6B, when the timer times up, the loader arm cylinder 51 starts its loading operation. The processed work W is removed out of the machine as a result that the stop device 54 synchronized with the operation of the loader arm 52 moved to a retracted position. On the other hand, the work W within the pocket 53 in the loader arm 52 is placed within a work rotating support device 55. This confirmation of the work W having been loaded is accomplished by a sensor se, and respective operation of the gauge 56 and the grindstone 57 are initiated and, after they are moved to a work processing position X0, a further processing is initiated.

After completion of the processing, the loader arm cylinder 51 starts its retraction after, as an indication of both of the grindstone 57 and the gauge 56 having been separated from the work W, an indication of the grindstone 58 having been retracted and an indication of the gauge 56 having been retracted have been entered.

In the above discussed case, the following first problem has been found.

In the above described operation, where the actuator is employed in the form of a hydraulic or pneumatic cylinder, switching of a valve and transmission of a pressure within the piping system take a substantial length of time and a delay necessarily occurs even through a sequence control signal is changed. Because of such a delay, not only does the sequence control require confirmation of the operation, but also difficulty is involved in installing and setting up limit switches required to accomplish confirmation of the operation.

By way of example, the delay of the sequencer runs from a few msec. to some tens msec., the switching of the valve may take some tens msec., and transmission of the pressure in the piping system accompanies not only a delay of about 100 msec., but also a variation in transmission time. In the case of the grinding machine such as shown in FIG. 7, about ten different operations take place and, therefore, even though a delay of individual controllers may be minimal, accumulation of those delays brought about by those controllers would be detrimental. In particular, a timer has been required so that during delivery of the work, the work can assuredly be stabilized at the placement position.

Elements which will bring about a delay may include as follows:

(1) Approach switch used to ascertain operation:

This switch generally has a delay of 1 msec. or less and has a high speed responding capability.

(2) Sequencer I/O signal:

In the case of an AC relay or the like, a delay may result from the power source frequency. The delay of 1/60 sec. at maximum may result in at 60 Hz. Even in the case of a DC relay, a delay of some tens of msec. may result.

(3) Sequencer processing time:

Although variable subject to the sequencer and the method of compiling its program, a delay of a few msec. or larger may result.

(4) Response of an electromagnetic valve:

Movement of a spool in the electromagnetic valve requires about some tens of msec.

(5) Transmission of a pressurized fluid:

Although variable subject to the length of the piping system, the rigidity of pipes and the difference in hydraulic or pneumatic pressure, a delay of some tens of msec. or larger may result.

As discussed above, the conventional loading apparatus and other machine operations necessarily involve a delay and a variation. Though attempts have hitherto been made to employ a servo valve for the hydraulic valve, the delay in the basic sequential control could not be removed. The details of the idle time (non-grinding time) of the grinding machine as far as the items (2) to (5) above are concerned are such as shown in FIG. 9.

Although the individual delay elements are small, a delay of about 1 sec. would occur when the operation is repeated seven times. Accordingly, it is one of the major factors that require improvement in the processing machine.

In order to minimize the delays, it may be contemplated to employ a servo system for the actuator which tends to bring about the smallest delay, and a grinding machine is currently available of a type in which the delay has been reduced by the use of a hydraulic servo system. However, what is provided with a servo system is only the loader arm which requires force, and even the hydraulic servo system requires a delay of some tens of msec. or large before it starts its operation.

The prior art associated with the grindstone sharpness will now be discussed.

The grindstone sharpness (the processing efficiency) tends to vary as it wears during the grinding cycle, and the value of the grindstone sharpness is one of the important factors to accomplish a control of cutting.

The grindstone sharpness is evaluated with $\Lambda$, which is expressed by the following formula, and the reciprocal of $\Lambda$.

$$\Lambda = (\text{Processing Force})/(\text{Processing Efficiency } Z)$$

In other words, the ratio of the processing force relative to the processing efficiency (Amount of works removed per unitary time) represents the grindstone sharpness. The processing force referred to above is represented by a value such as the orthogonal grinding force Fn(N), the tangential grinding force Ft(N), the grinding power P(kW) or the like. The unit of the processing efficiency Z is $mm^3$/sec., or $mm^3$/mm.sec.

In the above formula, If the parameter $\Lambda$ is large, the processing efficiency for a given processing force is low and, hence, the sharpness of the grindstone is low. On the other hand, if the parameter $\Lambda$ is small, a relatively large amount of material can be removed with a low processing resistance and, hence, the sharpness of the grindstone is considered favorable.

To evaluate the sharpness, both of the processing force and the processing efficiency must be detected, and the processing force can be determined in reference to a sensor signal indicative of the cutting deflection or the grinding power. The processing efficiency can, on the other hand, be determined by the utilization of a signal of an in-process gauge effective to detect the dimension of the work being processed.

With respect to the evaluation of the sharpness, reference will now be made to FIGS. 15 and 16. FIG. 15 illustrates an arrangement of equipments of the internal grinding machine being operated and FIG. 16 illustrates a condition of the machining process.

As shown in FIG. 15, the work W to be processed is mounted on shoes 6*a* and 6*b* and a driving plate 116 for rotation together therewith. The grindstone 4*a* is positioned inside the work W to be processed and performs a cutting in a direction transverse to the work W while being rotated. The dimensions to which the work W is to be processed are captured by a gauge contact (a detector support arm) 10*a* within the work W and are measured by an in-process gauge 10. The processing force (the grinding force) is measured by a sensor 119 for detecting deflection of a grindstone drive motor axis (not shown) or a deflection of a grindstone axis. At this time, the processing position (the processing point) of the grindstone 4*a* and the point of measurement by the in-process gauge 10 do not match with each other and, therefore, a possible error would occur in the measurement of the in-process gauge 10 as a result of a thermal expansion of the work W.

The processing process will be discussed. Referring to FIG. 16, when the rough processing is initiated during which cutting X (=advancing motion of the grindstone) takes place, the processing force P increases accompanied by a change in processing dimensions (measured values) g. Although the processing force P attains a predetermined value at the time of completion of the rough processing, a frictional heat resulting from grinding penetrates the work and, therefore, the processing dimensions would be greater than expected. While the processing dimensions that can be measured is expressed by g, the actual processing dimension are expressed by $g-\sigma$ (shown by the dotted line) because the dimensions containing a thermal expansion $\sigma$ taking place in the work (shown in FIG. 16 with the axis of ordinates expanded) are measured.

The quantity of the thermal expansion $\sigma$ of the work accompanies a considerable delay in time as compared with the change of the processing force and considerable expansion and contraction take place during the processing as shown therein. By way of example, the thermal expansion and the thermal contraction take place more than 10 $\mu$m in the case of an oil-based coolant or 5 $\mu$m in the case of a water-based coolant.

The above discussed case involves the following second problem:

Although the processing force can be obtained by measuring the grinding force and the grinding resistance, the processing efficiency can be obtained by the following equation in which D represents the diameter of the work to be processed and any influence brought about by the thermal expansion of the work is neglected.

$$Z \approx \pi \times D \times (dg/dt)\ mm^3/mm.sec)$$

For this reason, no accurate evaluation of the grindstone sharpness is possible. In particular, since the thermal expansion and contraction take place considerably in the work W from a time before completion of the rough processing and also during the finishing process and, therefore, the extent of inaccuracy of the measured value of the grindstone sharpness (the processing efficiency) is considerable.

Although any error in grindstone sharpness will not pose any greater problem in the case of a low-speed processing, an accurate measurement of the grindstone sharpness is necessary where a large number of works such as, for example, bearing races are processed at a high speed and, at the same time, must satisfy severe requirements for the accuracy. In particular, where the cutting control to be employed during the finishing process or the like is to be tailored, no stable control is possible unless the accurate grindstone sharpness is obtained.

Hereinafter, the prior art related to the bite retraction will be discussed.

To process the single work with the grinding machine, the rough processing and the finishing process are carried out successively to secure the processing efficiency and the processing accuracy. Where, for example, the internal grinding machine having a grinding system of a relatively low rigidity is employed, the bite retraction in a small quantity is carried out subsequent to the rough processing and the finishing process follows by releasing a deflection in the grinding system. In flus way, by effecting the bite retraction prior to the finishing process, the time required to finish the work can be shortened.

A condition of a deflection occurring in the grinding system is exaggeratedly shown in FIG. 17. In the case of the internal grinding, the grindstone axis 109*a* deflects under the influence of the processing force and, with cutting X1(t) an uncutting of a magnitude corresponding to the deflection δ will result in the work W. The processing dimensions X2(t) is a function of the depth of cut X1(t) and the grinding time constant X and is expressed as follows:

$$dX2(t)/dt=(1/\tau)\cdot(x1(t)-X2(t) \quad (1)$$

The grinding time constant τ referred to above varies depending on the grindstone sharpness (the processing efficiency), the material of the work to be processed, the shape of the work and so on.

The processing conditions (processes) in which the deflection is released by accomplishing the bite retraction and in which it is not released, respectively will be discussed by referring to the comparison between FIGS. 18A and 18B.

In order to secure the grinding accuracy, it is necessary to maintain the deflection δ(t) at the termination of the cutting at a predetermined value or less. Where no bite retraction is effected, the length of time corresponding to three times the grinding time constant is needed to restore the deflection that takes place during the finishing process. On the other hand, where the bite retraction is effected, it is possible to effect the cutting more than expected during the rough processing and, since the deflection can be restored before the finishing process, the deflection can be quickly restored during the finishing process. Thus, the process time can be shortened.

With the grinder hitherto available, two exemplary methods of determining the amount of the bite retraction are employed: One is to determine the amount of the bite retraction by repeating grinding experiments so that the processing cycle and the processing accuracy can be stabilized and this method is largely employed. The other is to accomplish an automatic bite retraction wherein, if the processing force and the processing power are controlled, for example, in the case of the power control, the following equation is assumed;

Amount of Bite retraction Xbo=Control System Constant×(Pr−Pf) wherein Pr represents the power (kW) set during the rough processing and Pf represents the power (kW) set during the finishing process.

However, with these amounts of the bite retraction, the cycle tends to become unstable if the speed of cutting during the finishing process is decreased and/or the power set during the finishing process is lowered, accompanied by considerable variation in time required to accomplish the finishing process. For this reason, the finishing allowance and the cutting time must be increased so that the amount of the bite retraction can be decreased. Also, even in the case where the sharpness of the grindstone such as a CBN grindstone tends to vary considerably before and after dressing and/or the processing allowance tends to vary, the cycle tends to become unstable.

The above discussed case involves the following third problem:

In view of the foregoing situations, it is desired to develop a method of determining the amount of the bite retraction with which even in the presence of the above discussed reasons for the instability, a stabilized grinding cycle can be accomplished. Therefore, the following method of determining the bite retraction has been conceived.

The basic characteristic of the grinding process can be expressed as follows:

Speed of Growth of Work Dimensions: V(t)=dX2(t)/dt, and

Grinding Deflection: δ(t)=X1(t)−X2(t).

Therefore, the equation (1) referred to hereinbefore can be rewritten as follows.

$$V(t)=\delta(t)/\tau \quad (2)$$

This can be construed as δ(t)=τ·V(t) and, therefore, the grinding deflection is equal to the product of the speed of growth of the dimensions of the work (which may be substantially equal to the cutting speed, dX1(t)/dt, if the deflection is stabilized) times the grinding time constant.

The amount of the bite retraction is used to render the rough grinding deflection to be the finishing grinding deflection. Accordingly, if during the rough processing the speed V(t) of growth of the work dimension used in the equation (2) above or both of the cutting speed dX1(t)/d and the grinding time constant τ(t) are available, the deflection δ(t) can be calculated and the optimum amount Xbo of the bite retraction at which the process goes onto the finishing process can also be calculated.

However, in performing the control by the utilization of the amount of the bite retraction Xbo so calculated, there is a third problem in that no NC device is available which has a capability of changing the amount of the bite retraction during the cutting. The NC device has a capability that in order to determine the path at the time of start of the processing, the speed can be changed by an override, but nothing is available which can change the position during the processing.

For this reason, it is necessary to develop a NC device of a type in which the amount of the bite retraction after completion of the rough processing can be changed during the rough processing.

Also, since the finishing process is predicated to achieve the control during the rough processing, a delay in the control system and also in the mechanical system poses a considerable problem. Nevertheless, since an abrupt change of the grinding time constant does not occur so often, the value of the previously processed work during the processing of such work can be used, but it is desirable to determine the grinding time constant of the work being currently processed in order to accomplish an improvement in accuracy.

In view of the above, an in-process measuring method of obtaining the grinding time constant of the work being currently processed will be considered. During the grinding, the grindstone sharpness tends to vary as discussed in connection with the second problem. Change in grindstone sharpness result in change of the grinding time constant and in turn change in control gain of the grinding system. In the case where the processing process is to be controlled, it is necessary to accurately grasp this change.

The grinding time constant $\tau$ is expressed as follows:

$\tau=\alpha/[(\text{Rigidity in Grinding System Kg})\times(\text{Grindstone Sharpness }\Lambda)]$ wherein $\alpha$ represents the constant determined by the work.

$\Lambda=(\text{Grinding Force Fn(N)})/(\text{Processing Efficiency Z } (mm^3/sec))$ In other words, the grinding time constant $\tau$ is inversely proportional to the grindstone sharpness A.

Where the same works are continuously processed, the constants $\alpha$ and Kg may be considered to be the respective constant values and, once the grindstone sharpness $\Lambda$ is available, the grinding time constant $\tau$ can be fixed.

Change in grindstone will now be considered. Assuming that the grinding time constant is $\tau\mathbf{0}$ at a reference grindstone sharpness A0, the grinding time constant $\tau t$ when the grindstone sharpness attains Aa during the processing can be expressed as follows:

$$\tau t=\tau 0\times(Aa/A0)$$

The second problem is associated with the manner by which the grindstone sharpness during the processing is determined.

A method of calculating the cutting speed V(t) will now be described. The cutting speed V(t) is readily understood as meaning a speed of processing the workpiece which is expressed by dX2(t)/dt. Where an in-process gauge is employed, the cutting speed can readily be obtained by differentiating the dimension signal.

Where no in-process gauge is employed and only the power or the processing force is detected, it can be obtained by the following manner. Namely, the deflection $\delta(t)$ in FIGS. 18A and 18B is the same as the grinding power and the grinding resistance and, since when it becomes an ordinary condition, dX1(t)≈dX2(t), dX1(t)/dt can be obtained by determining that the power or the processing force attains an ordinary condition.

The method of determining the amount of the bite retraction will now be considered. If the grinding time constant $\tau$ and the cutting speed V could be detected, the grinding deflection $\delta(t)$ can be calculated by the equation, $\delta(t)=\tau\times V(t)$. It is recommended to use this grinding deflection $\delta(t)$ as the amount of the bite retraction.

If the NC device of a type in which the amount of the bite retraction after completion of the rough processing can be changed during the rough processing as discussed in connection with the third problem discussed above could be developed, during the rough processing a preset value of the NC device is re-memorized so that the value of the previously discussed grinding deflection $\delta(t)$ may represent the amount Xbo of the bite retraction.

However, at this time, there is a fourth problem in which a delay may occur in the cutting system. In a general NC device, a delay of some tens of msec. occurs during a transit from the rough processing to the bite retraction or the finishing process. Although variation may be small, it is a composite delay in which a delay in the mechanical system and a delay in the electric system are combined. Also, change in grinding time constants is an addition and an unstable phenomenon of the grinding cycle such as, for example, variation in length of time required to accomplish the finishing may occur. In the case where the cycle is unstable, it is reflected by variation in processing accuracy and, therefore, adjustment is needed to reduce the cutting speed.

Hereinafter, the prior art associated with the grinding process time will be discussed.

In the practice of the grinding process, the rough grinding and the finishing grinding are carried out within one cycle to process the single work. Also, in the case of the grinding in which the processing system is of a low rigidity such as found in the internal grinder or the like, as hereinbefore discussed, the bite retraction is carried out in a small quantity after the rough processing to open the deflection to thereby decrease the time required to accomplish the finishing process.

The efficiency of the rough processing is related to the magnitude of wear or separation of the grindstone and is limited to a range in which deterioration of the processing accuracy is minimal. Although in order to reduce the processing time, the finishing allowance is to be reduced to thereby decrease the time required to accomplish the finishing, the time required to accomplish the finishing process may vary depending on a change in finishing allowance if the finishing cutting speed is slowed to secure the processing accuracy.

FIG. 13 illustrates a chart showing a processing process which is illustrated in connection with one of preferred embodiments in this specification as a novel method for setting the amount of the bite retraction after the rough processing as will be described later. With reference to this figure, problems associated with the finishing process will be discussed.

Referring to FIG. 13, when the cutting X1(t) is initiated, the processing of the work is initiated and the work dimension g(t) varies progressively. At this time, the deflection $\delta(t)$ is equal to X1(t)−g(t), which increases slowly and finally converges to a predetermined value. The grinding force and the grinding power P(t) are proportional to $\delta(t)$.

In this way, when the in-process gauge detects the work dimension having attained the finishing allowance g1, the control device commands the NC device to start the bite retraction. However, before the cutting speed changes, a delay corresponding to the time t1 during which the rough grinding takes place and the time t2 during which it stops until the bite retraction is initiated occurs. Even a delay corresponding to the time t3 required for the finishing cutting to start occurs. Nevertheless, there is a delay of the time t5 even after the termination of the grinding and before the in-process gauge detects the completed dimension g0, and therefore, the finished dimension is different from the completed dimension. Those delays are fixed for a given machine and are generally a known value.

Assuming that the grinding allowance at the time t1 is expressed by r1, the allowance at the time t2 is expressed by r2 and the allowance at the time t3 is expressed by r3, the allowance Xf(=g3) remaining after the bite retraction is expressed by the following equation:

$$Xf=g1-r1-r2-r3$$

The following fifth problem is found in the above discussed case.

At the time discussed above, although in the order of $\mu$m, variation in amount of the bite retraction and errors in measurement by the in-process gauge are found. Even though the error is about 5 $\mu$m, variation of the processing time the order of 1 sec. may result in if the finishing cutting speed is 5 $\mu$m/sec. This brings about a difficulty in management of the processing site and also in standardization of the processing conditions. If the delay in cutting is large and the finishing allowance g1 is reduced, it may occur that the finishing process cannot be executed.

In the practice of the grinding job hitherto done, those inconveniences have been counteracted by increasing the finishing allowance and, on the other hand, setting the finishing cutting speed to a higher value. Also, since a delay in cutting may occur at the time of termination of the finishing process, the processing accuracy may be deteriorated if the processing resistance is high and/or if the work processing speed is high. Hitherto, a so-called spark-out grinding has been performed in which the cutting is stopped to maintain the processing accuracy. This tends to being about an unnecessary increase of the processing time.

SUMMARY OF THE INVENTION

The present invention has been devised to substantially eliminate the first problem discussed above and is intended to provide a grinding machine wherein a delay occurring in any one of the drive system and the control system during execution of sequential operations of the various component parts to thereby accomplish an easy control at a highspeed.

In order to substantially eliminate the first problem, there is provided a grinding machine which comprises a device driven by an electric motor for selectively delivering and removing a work to be processed to and from a processing position, respectively; a grindstone retracting device driven by an electric motor for selectively advancing and retracting a grindstone; a gauge retracting device driven by an electric motor for selectively advancing and retracting a gauge to and from the work at the processing station, respectively; a reference pulse generating means for generating a predetermined number of reference pulses; a position change curve setting means provided in each of the electric motors; and a servo controller for controlling each of the electric motors in response to a position command outputted from the position change curve setting means. The position change curve setting means referred to above is of a type operable in response to receipt of the reference pulse to output the position command corresponding to the number of input pulses representative of a predetermined position change curve.

The reference pulse generating means comprises a sequencer, a personal computer or the like and generates a predetermined number of reference pulses which may corresponds, for example, to a predetermined cycle of grinding operation. These reference pulses are distributed by a pulse distributor to the various position change curve setting means which subsequently output the respective position commands representative of the position change curves to the servo controller for the various electric motors used to drive the various devices. The position change curve setting means is of a type in which a so-called cam function is implemented by an electronic control and stores, in the form of a position change curve, the position corresponding the respective reference pulse and can output in response to receipt of the reference pulse the position commands, corresponding to the number of the inputted pulses, each time the single pulse is inputted. For this reason, merely by formulating one kind of the reference pulse with the reference pulse generating means which is a high-end control means, a multi-axis synchronized control is possible and a multi-axis synchronizing operation can easily be accomplished at a high speed.

In addition, since the work delivering and removing device, the grindstone retracting device and the gauge retracting device are all driven by respective electric motors, there is no delay in a piping system which would occur as when hydraulic or pneumatic pressure time used, and therefore the response is high.

In the structure described above, the work delivering and removing device, the grindstone retracting device and the gauge retracting device are preferably driven by the respective electric motors through associated reduction gear units. The intervention of the respective reduction gear unit makes it possible to use a compact servo-motor to thereby contribute to a further increase in response. For this reason, no confirmation of operation with the use of proximity switches and/or sensors for detecting various operations is needed to eliminate a waste time resulting from accumulation of times required to accomplish the confirmation. Accordingly, in view of the use of the position change curve setting means, the multi-axis synchronization can be carried out at a high speed with the simple control.

In a preferred form of the grinding machine according to the present invention, the work delivering and removing device comprises an entry chute for guiding an unprocessed work towards a receiving and discharge position in the vicinity of the processing station, a discharge chute for discharging the work, which has been processed, from the receiving and discharge position, a loader arm having a pocket for accommodating the work and a stopper, the loader arm being reciprocatingly movable between a closing position, at which the stopper closes the entry chute with the pocket held at the processing position, and a communicating position at which the pocket is communicated with the entry and discharge chutes, and a pusher for pushing the work at a front end of the entry chute towards the receiving and discharge position. In this structure, the pusher starts pushing the unprocessed work while the loader arm is being returned from the processing position towards the receiving and discharge position, to cause the unprocessed work to push the processed work within the pocket until the unprocessed work is pushed into the pocket.

Thus, since the pusher starts its pushing operation to push the unprocessed work when the loader arm is being returned from the processing position towards the receiving and discharge position, the processed work within the pocket can be completely replaced with the unprocessed work by the time the loader arm returns to the receiving and discharge position. Accordingly, the loader arm can start its return to the processing position with no wait time.

The present invention has also been devised to substantially eliminate the second problem and is intended to provide a grinding method and a grinding machine wherein change in grindstone sharpness resulting from wear of the grindstone can accurately evaluated during the process and the accuracy of a control of the processing process during a high speed processing can be increased.

In order to substantially eliminate the second problem, the grinding sharpness is accurately calculated using, as a value of the processing dimension of the work, a real processing dimension of the work which is the processing dimension of the work obtained from an in-process gauge and compensated for the amount of thermal expansion of the work.

In other words, the grinding method and machine according to this invention is such that a grinding sharpness A represented by the ratio, or a reciprocal thereof, of a processing force, represented by a grinding force or a grinding power, relative to a processing efficiency represented by the product of the amount of change of a processing dimension per unitary time times a processing circumference, is determined during a grinding process, and a cutting is controlled according to the grindstone sharpness which has been determined. In this system, a real processing dimension of the work which is the processing dimension of the work obtained from an in-process gauge and compensated for the amount of thermal expansion of the work is used as a value of the processing dimension of the work, and the amount of thermal expansion of the work referred to above is calculated from the grinding power.

Thus, by determining the processing efficiency in reference to the real processing dimension of the work, the real processing efficiency can be calculated to provide the accurate grindstone sharpness. Also, since the amount of thermal expansion of the work is calculated from the grinding power, compensation for the thermal expansion can be carried out during the grinding process. For this reason, the subsequent cutting control can be carried out by obtaining the accurate grindstone sharpness during the grinding process and then controlling the cutting according to the value of the grindstone sharpness and, therefore, the grinding process can be finished accurately and at a high speed. By way of example, the bite retraction to be performed subsequent to the rough grinding process and the cutting control to be performed during the finishing process can be carried out accurately and any complicated control is possible at a high speed.

The present invention has furthermore been devised to substantially eliminate the third problem discussed hereinbefore and is intended to provide a grinding method and machine capable of setting the amount of the bite retraction, wherein a stabilized grinding cycle can be accomplished even in the presence of unstable factors such as change in finishing cutting speed and finishing preset power.

The present invention has yet been devised to substantially eliminate the fourth problem discussed hereinbefore and is intended to provide a grinding method and machine capable of setting the amount of the bite retraction with due regard paid to the delay in response of the mechanical system and the electric control system and also capable of accomplishing a processing with stabilized accuracy and without the processing efficiency being lowered.

A still further object of the present invention is to provide a grinding machine simple in structure and having a high versatility, wherein during the rough processing the setting of the amount of the bite retraction to take place after completion of the rough processing can be changed.

In order to substantially eliminate the third and fourth problems referred to above, the grinding method and machine of the present invention are such that a cutting is controlled by effecting a bite retraction upon completion of a rough grinding process so that a finishing grinding process may be performed subsequently. In this method and machine, respective predetermined items are measured during the rough grinding process with respect to a work and a grinder, and, while the predetermined items are measured, the amount of the bite retraction for which the bite retraction is to be carried out is calculated in reference to the measured predetermined values, whereupon the bite retraction is effected in a quantity corresponding to the calculated bite retraction amount upon completion of the rough grinding process.

Thus, by calculating the amount of the bite retraction to be effected upon completion of the rough grinding process in reference to the value measured during the rough grinding process and then effecting the bite retraction according to the calculated bite retraction amount, the bite retraction amount can be optimized to fit to the change in grindstone sharpness. Also, even without being affected by the unstable factors such as change in finishing cutting speed and/or finishing preset power, the bite retraction amount can be optimized and a stabilized grinding cycle can be accomplished. Accordingly, the finishing allowance need not be unnecessarily increased, and a high speed processing can be realized. In addition, although since the control of the bite retraction amount is carried out by predicating the finishing process during the rough processing, the delay in response of the control system and the mechanical system would pose a detrimental problem, the processing with stabilized accuracy can be accomplished without the processing efficiency being lowered, by determining the bite retraction amount in consideration of the various delay.

Furthermore, since while the respective predetermined items are measured during the rough grinding process, the amount of the bite retraction for which the bite retraction is to be carried out is calculated in reference to measured predetermined values, the cutting control device for carrying out a numerical control of the grinding machine and the measurement and control device for calculating the bite retraction amount which is one of the processing conditions are independent from each other and, therefore, these devices may be simple in structure and of a type having a high versatility.

The present invention has furthermore been devised to substantially eliminate the fifth problem discussed hereinbefore and is intended to provide a grinding method and machine wherein, even in the presence of the change in allowance and/or grindstone sharpness, the grinding process time can be controlled to a target value even during a high speed grinding process and the processing accuracy can also be stabilized.

In order to substantially eliminate the fifth problem, a first grinding method and machine both effective to substantially eliminate the fifth problem are such that a finishing allowance after a rough grinding process is measured by the use of an in-process gauge and a processing power, exhibited from the start of a finishing grinding until completion of the finishing grinding, is linearly decreased at a gradient appropriate to a measured value of the finishing allowance. Though the processing power is expressed in terms of energies, the processing force expressed in terms of force may be linearly decreased in place of the processing power.

While during the grinding process variation in finishing allowance is unavoidable, the stabilized accuracy and the stabilized processing cycle can be obtained by measuring the finishing allowance subsequent to the rough grinding and then controlling the process time to be constant and also controlling the processing resistance at the time of termination of the finishing process to be of a low value.

A second grinding method and machine effective to substantially eliminate the fifth problem referred to above are such that a preset value of a finishing grinding allowance with which completion of a rough grinding is determined, is changed in reference to a measured value of a processing dimension obtained from an in-process gauge during the rough grinding, with a predetermined calculated value appropriate to a difference between a target value of a finishing process time and a real finishing process time.

Thus, by changing the preset value of a finishing grinding allowance with which completion of a rough grinding is determined, relative to a measured value of a processing dimension, the allowance during the finishing process can be adjusted to make it possible to control the finishing process time to a desired time.

The first and second grinding method and machine both designed to substantially eliminate the fifth problem discussed hereinbefore may be employed in combination. In other words, the grinding method and machine in which the first and second grinding methods are employed in combination are featured in that the preset value of a finishing grinding allowance with which completion of a rough grinding is determined relative to a measured value of a processing dimension obtained from an in-process gauge, is changed with a predetermined calculated value appropriate to a difference between a target value of a finishing process time and a real finishing process time, and the finishing allowance after the rough grinding is measured with the use of the in-process gauge so that the processing power or a processing force, exhibited from the start of a finishing grinding until completion of the finishing grinding, can be decreased linearly at a gradient appropriate to a measured value of the finishing allowance.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, the present invention will be described in connection with preferred embodiments with reference to the accompanying drawings.

The drive and the control according to one embodiment of the present invention will be described with reference to FIGS. 1A to 4C. It is to be noted that in this illustrated embodiment, in order to eliminate a delay occurring in hydraulic and pneumatic valves and a piping system, and also to eliminate a waste time brought about during confirmation by various sensors and sequencers, actuators used in the machine are employed in the form of an compact electric motor and a reduction unit to speed up the response; that the necessity is eliminated of confirmation of operation by proximity switches so that synchronization between a servo controller and a position change curve setting means which forms an electronic cam mechanism can be accomplished by a simple control; and that a work exchanging device is so designed and so configured as to eliminate an unnecessary waste of time which would be required during the work exchange.

Figure 1A:
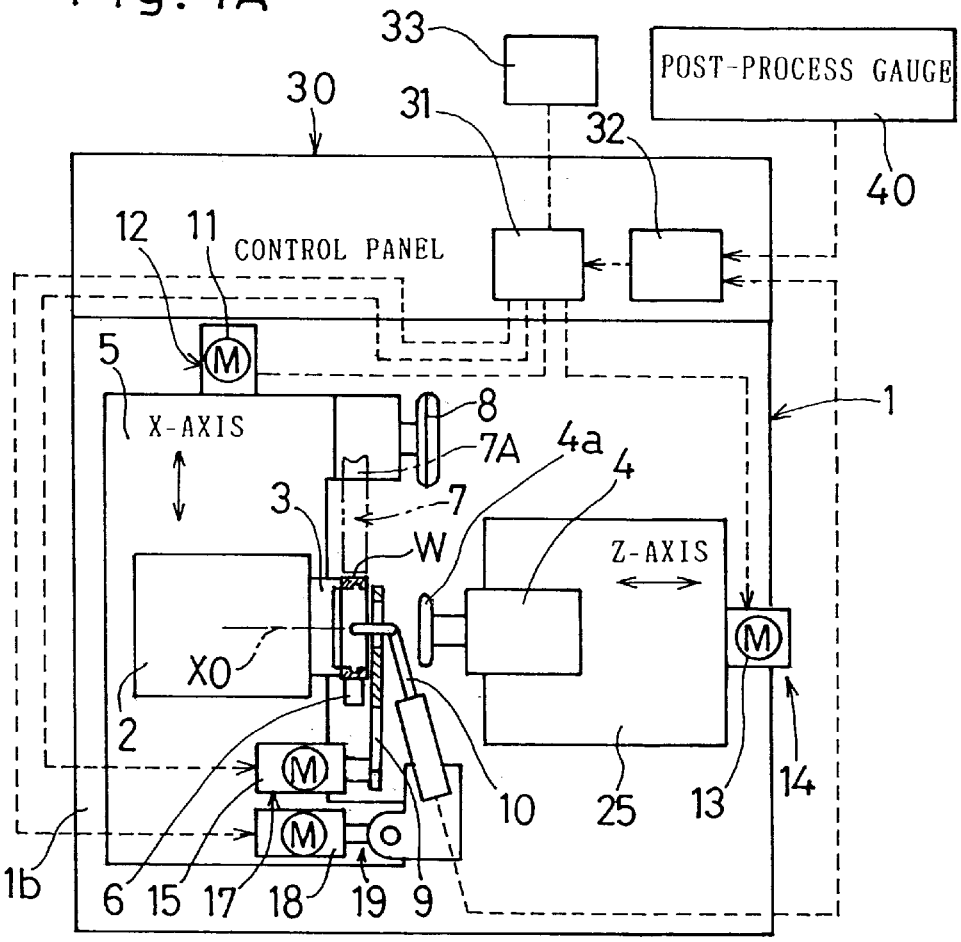
FIG. 1A is a plan view of a grinding machine according to one preferred embodiment of the present invention.

FIG. 1A illustrates a plan view of the grinding machine. This grinding machine comprises a grinder 1 and a control panel 30. The grinder 1 is an internal grinder and includes a main shaft support 2 mounted on a bed 1*b* together with a retractable bench 5 for movement in a cutting direction (an X-axis direction), that is, leftwards and rightwards, and a grindstone support 25 mounted on the bed 1*b* for movement in a direction (a Z-axis direction), that is, forwards and rearwards, relative to a main shaft 3 held at a processing position X0. The main shaft 3 has a front end provided with a driving plate (not shown) which may be an electromagnetic chuck capable of holding a work W supported on a work rotary support device 6 disposed on the bed 1*b*. A chute 7A of a work exchange device 7 for exchanging the work W relative to the main shaft 2 at the processing position X0 is disposed on the bed 1*b*. The work W may be an outer race of a rolling contact bearing such as, for example, a ball bearing. The grindstone support 25 is of a type mounted with a grindstone drive motor 4 for rotating a disc-shaped grindstone 4*a*. The retractable table 5 has, in addition to the main shaft support 2, a dress device 8, a loader arm 9 of the work exchange device 7 and an in-process gauge 10 all mounted thereon.

Figure 3A:
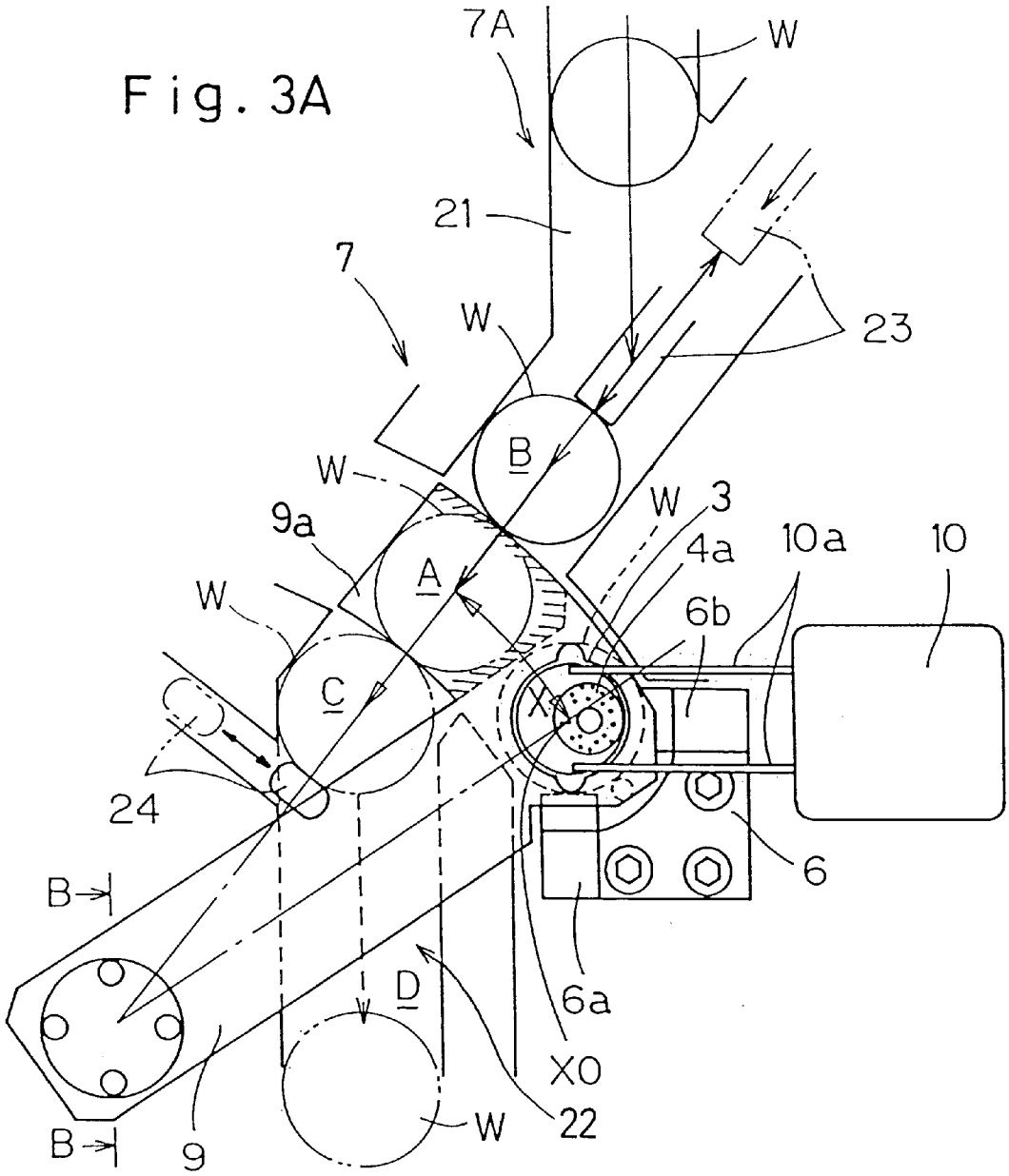
FIG. 3A is a front elevational view of a work delivering and removing device.
Figure 3B:
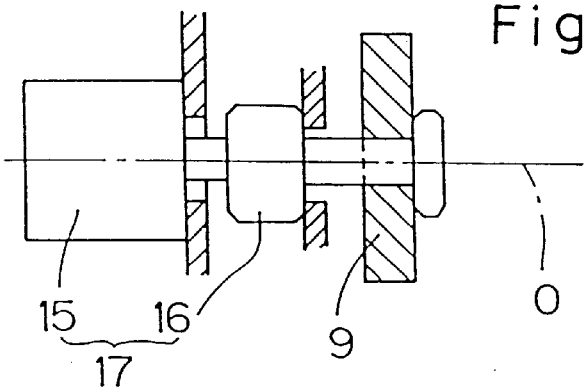
FIG. 3B is a cross-sectional view taken along the line B—B in FIG. 3A.

The main shaft support 2 is retractably driven by a main shaft support retracting device 12 including an electric motor (a cutting drive motor) 11 and a feed screw (not shown), and the grindstone support 25 is retractably driven by a grindstone retracting device 14 including an electric motor (a grindstone drive motor) 13 and a feed screw (not shown). The loader arm 9 is, as shown in FIG. 3B, rotated a predetermined angle in either direction about a horizontal axis O by an arm drive device 17 including an electric motor 15 and a reduction gear unit 16. The in-process gauge 10 is driven by a gauge retracting device 19, including an electric motor (a gauge inserting and removing device) 18 and a reduction gear unit (not shown), so as to selectively enter into and separate from the work W. As shown in FIG. 3A, the in-process gauge 10 includes a detector element (not shown), on respective ends of a pair of detector support arm (gauge contacts) 10*a*, to measure the inner diameter of the work W. The work rotary support device 6 includes a shoe 6*a* for supporting a lower surface of the work W and a shoe 6*b* for supporting a side face of the work W as shown in FIG. 3A.

Each of the various electric motors 11, 13, 15 and 18 is employed in the form of an electric compact servo-motor and is designed to provide an output by the utilization of the reduction gear unit 16 (FIG. 3B) . . . . Thereby, a characteristic of the electric compact servo-motor excellent in high speed response can be effectively utilized.

With respect to the work exchange device 7, since in situ determination of a timer used to exchange the work W is difficult, a device having a mechanism effective to accomplish the work exchange in a short time of 0.1 sec. or less has been developed, an example of which is shown in FIGS. 3A and 3B and FIGS. 4A and 4B.

As shown in FIG. 3A, the work exchange device 7 includes an entry chute 21 for guiding an unprocessed work W towards a receiving and discharge position A adjacent the processing station, a discharge chute for discharging the processed work W from the receiving and discharge position A, the loader arm 9 referred to hereinbefore, a pusher 23 for pushing the work W, at one end of the entry chute 21, towards the receiving and discharge position A, and a stopper 24. The stopper 24 is capable of moving between a position (shown by the solid line), at which the work W at an upper position C within the discharge chute 22 can be supported, and a stand-by position (shown by the phantom line). The entry chute 21 is formed with a vertical portion and an inclined portion extending from a lower end thereof and bent acutely so as to extend in a direction diagonally downwardly. The discharge chute 22 has a vertical portion acutely bent so as to extend from an inclined portion that is continued straightly from the inclined portion at the end of the entry chute 21.

Figure 4A:
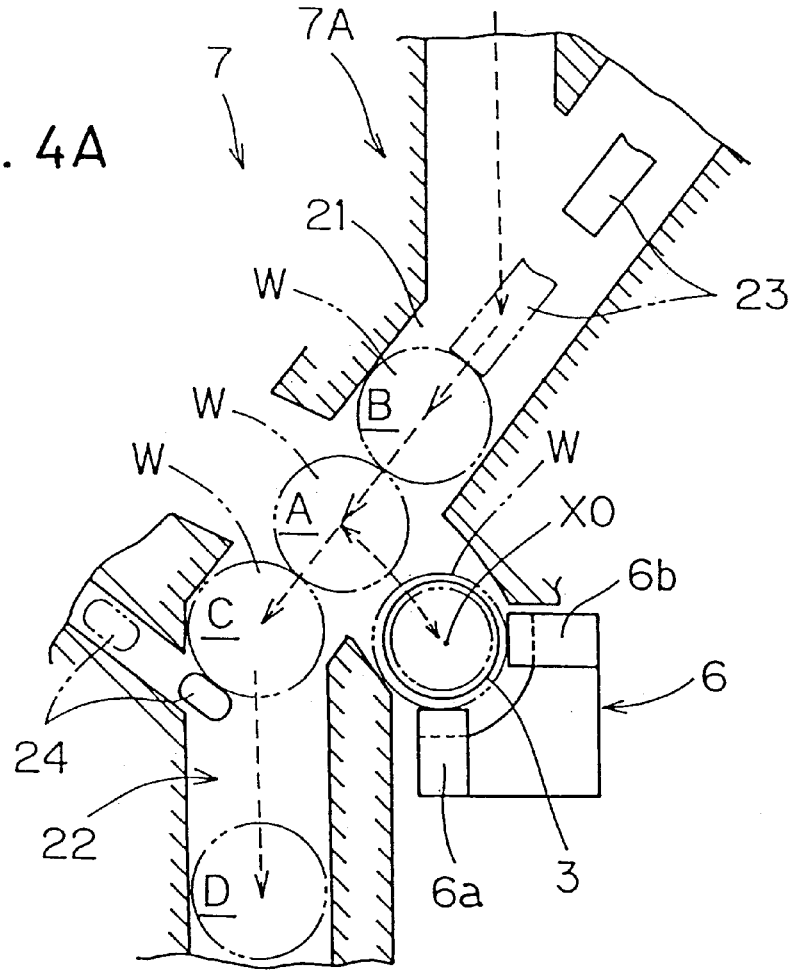
FIG. 4A is a front elevational view, with a portion cut away, showing a chute employed in the work exchanging device.
Figure 4B:
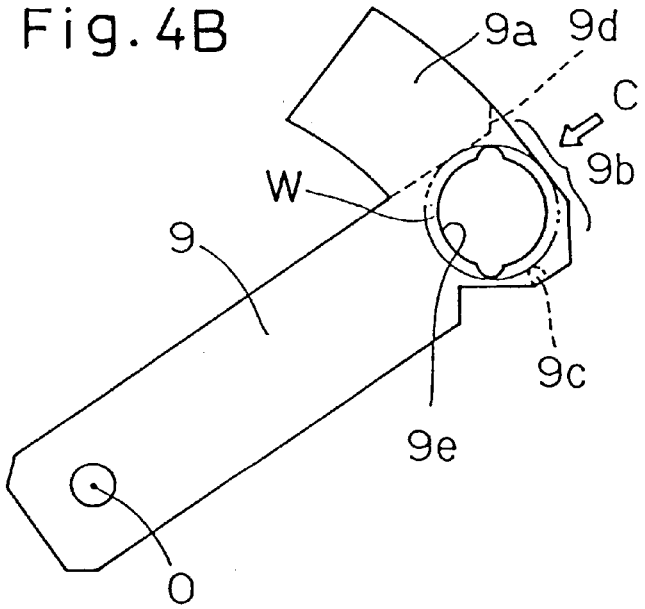
FIG. 4B is a front elevational view of a loader arm.
Figure 4C:
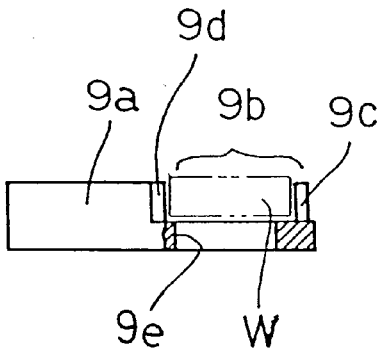
FIG. 4C is a perspective view of FIG. 4B as viewed in a direction shown by the arrow C.
Figure 5:
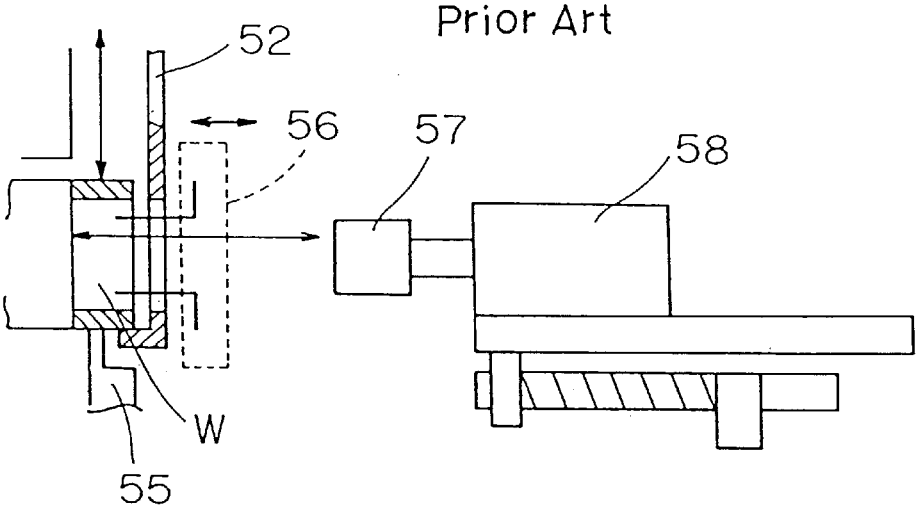
Fig.5 Prior Art
FIG. 5 is a fragmentary sectional view of the prior art grinding machine.
Figure 6A:
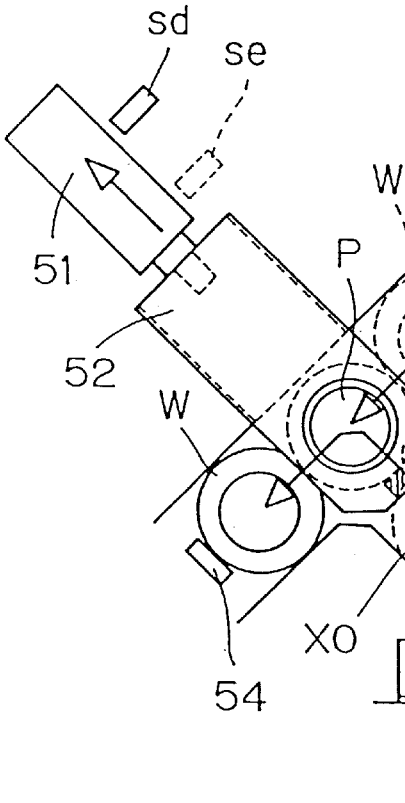
Fig. 6A Prior Art
FIGS. 6A and 6B are explanatory diagrams used to explain the operation of the work exchanging device used in the prior art grinding machine.
Figure 6B:
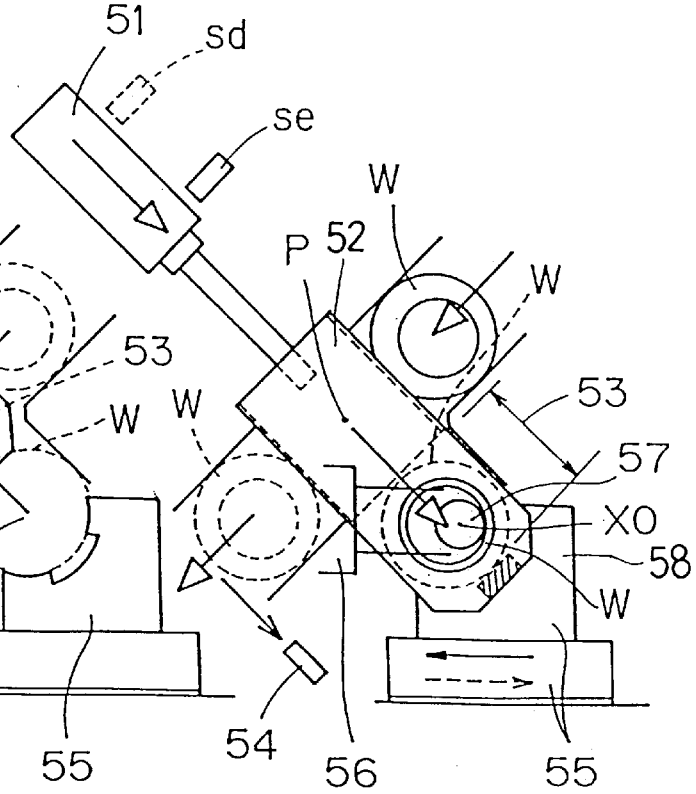
Fig. 6B Prior Art
Figure 7:
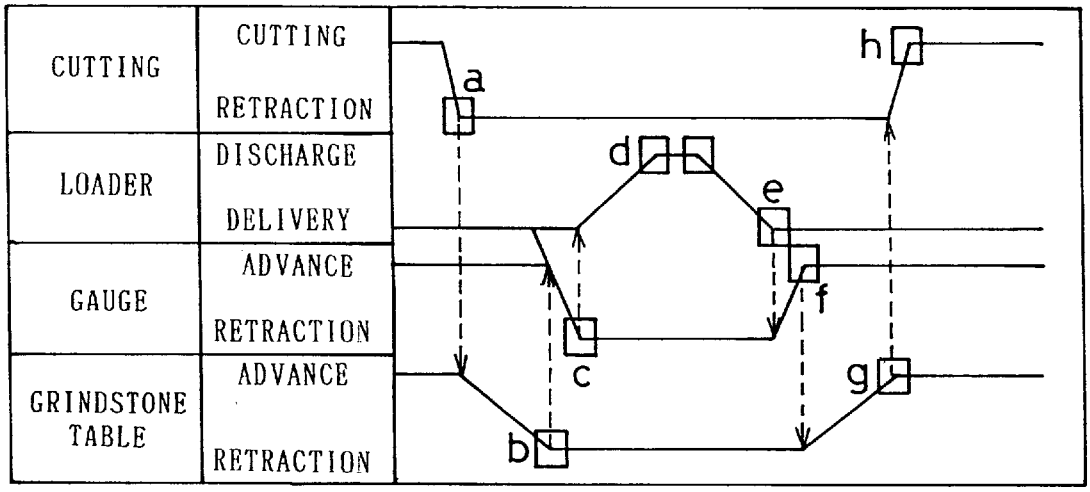
Fig. 7 Prior Art
FIG. 7 is an explanatory diagram showing the sequence of operation of various component parts of the prior art grinding machine.
Figure 8:
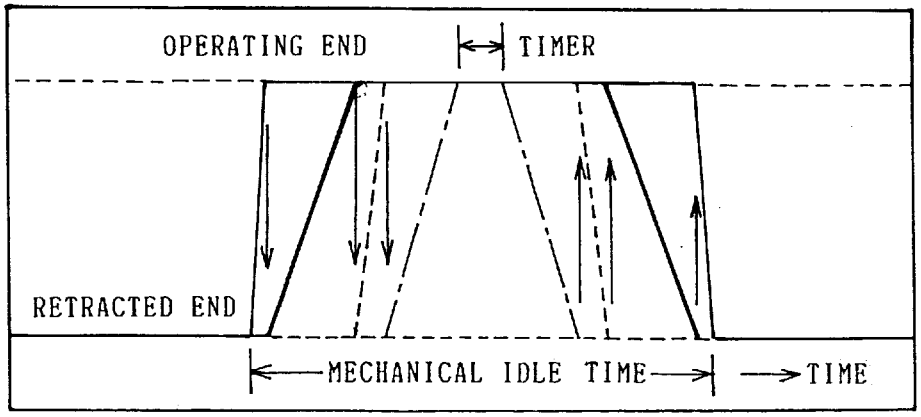
Fig. 8 Prior Art
FIG. 8 is a time chart of the prior art.
Figure 9:
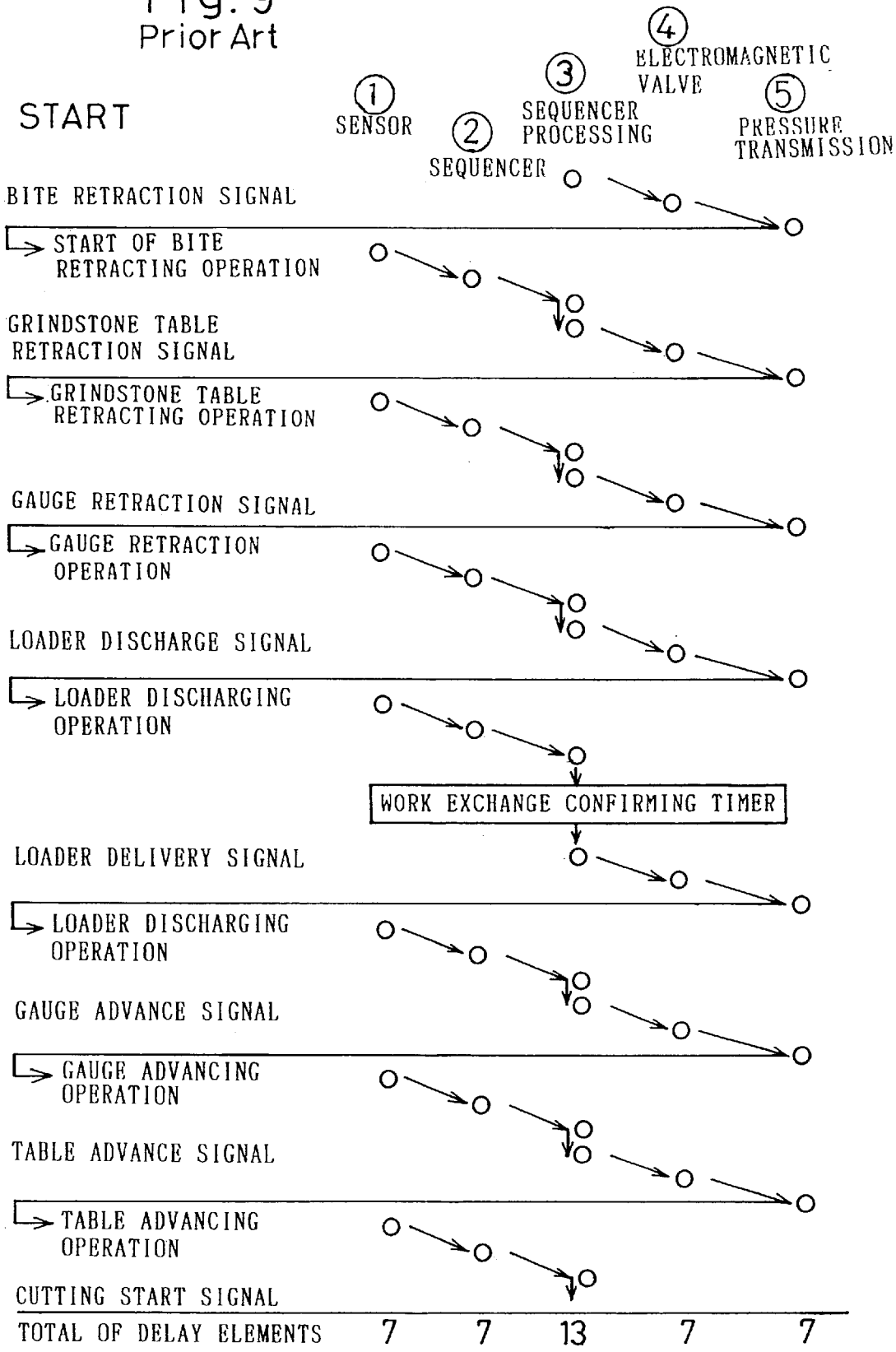
Fig. 9 Prior Art
FIG. 9 is a timing chart showing relations in signal transmission in the sequence of operation of the prior art grinding machine.

The loader aim 9 is, as shown in FIG. 4B, provided with a stopper 9*a* protruding laterally of a front end thereof towards a rear surface (towards the main shaft), a pin 9*c* fixedly mounted on one of opposite side edges remote from the stopper 9*a*, and a pocket 9*b* defined between the stopper 9*a* and the pin 9*c* for receiving the work W. A free end face of an arm of the stopper 9*a* is provided with a tapered portion 9*d* defined on one side edge adjacent the pocket 9*b*. Also, a front end of the loader arm 9 has a hole 9*e* defined therein in alignment with the pocket 9*b* so that the grindstone 4*a* and the detecting element of the in-process gauge 10 can be moved into and away from the hole 9*e*.

The work exchange device 7 operates in the following manner. In a condition shown in FIG. 3A in which the work W is positioned at the processing position X0, the work W is supported by the shoes 6*a* and 6*b* within the pocket 9*b* (FIG. 4B) in the loader arm 9 and is chucked by the main shaft 3. A so-called shoe-supported grinding takes place. Through the hole 9*e* at the front end of the loader arm 9 shown in FIG. 4B, the grindstone 4 and the in-process gauge 10 contact the work W to perform a processing and a measurement.

The next succeeding work W to be subsequently processed is pushed by the pusher 23 at a front end position B of the entry chute 21 towards the arm stopper 9*a* of the loader arm 9. Also, the previously processed work W is advanced towards the position shown by the solid line after the work W has been allowed to flow towards a lower position D of the discharge chute 22 when the stopper 24 is retracted to the position shown by the broken line. In this condition, no work W exist in the upper end position C of the discharge chute 22 and is therefore empty.

Upon completion of the processing, the compact motor 15 shown in FIG. 3B rotates at a high speed to cause the loader arm 9 through the reduction gear unit 16 to rotate from the processing position X0 shown in FIG. 3A towards the receiving and discharge position A. During this rotation, the pusher 23 starts pushing the unprocessed work W at the position B and, when the loader arm 9 arrives at the receiving and discharge position A, the unprocessed work W then held at the position B is received in the receiving and discharge position A. In other words, it is accommodated within the pocket 9*b* (FIG. 4B). At this time, the processed work W is held still at the position C by the action of the stopper 24 and the loader arm 9 is rotated in a reverse direction from the position A towards the processing position with no wait time.

The control system will now be described. As shown in FIG. 1A, the control panel 30 is disposed in the vicinity of one side of the bed 1*b* and includes a position control device 31 and a correcting device 32. The correcting device 32 is operable to perform a predetermined calculation using measurements given by the in-process gauge 10 and a post-process gauge 40, respectively, to supply various correction commands to the position control device 31. The position control device 31 is a means for controlling the various motors 11, 13, 15 and 18 and controls them in accordance with a high-end control device 33 such as, for example, an NC device or a line controller or the like. The position control device 31 has a mechanism simplified by synchronizing the servo-motors and also by eliminating the use of confirming equipments for confirming operations such as, for example, proximity switches, to thereby eliminate a possible delay in the control system.

Figure 1B:
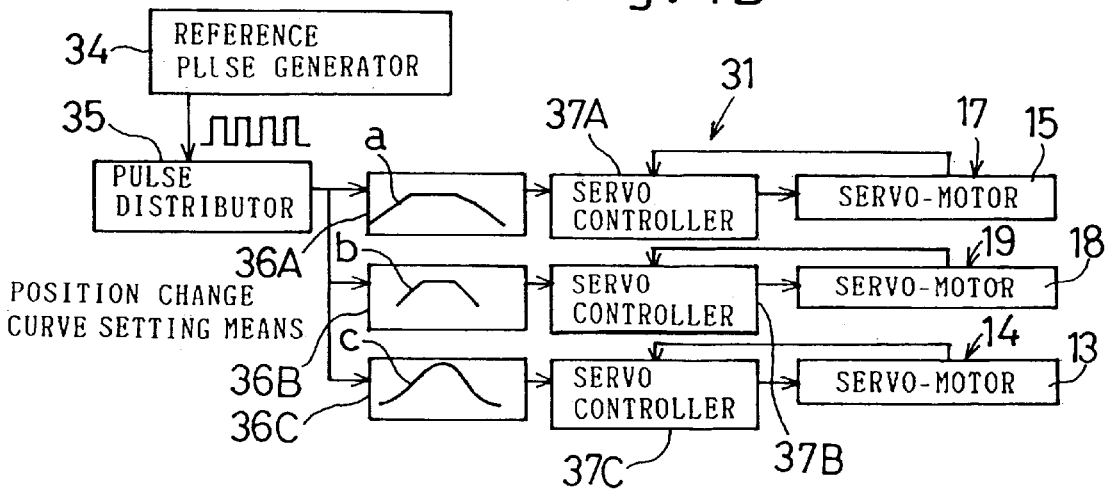
FIG. 1B is a conceptual diagram showing a position control device employed therein.

FIG. 1B illustrates a conceptual diagram of the position control device 31. This position control device 31 performs a synchronous control, on a single axis basis, of the respective motors 15, 18 and 13 of the work exchange device 7, the gauge retracting device 19 and the grindstone retracting device 14 all shown in FIG. 1A, and includes a reference pulse generating means 34, a pulse distributor 35, position change curve setting means 36A to 36C which may be so-called electronic cams, and servo controllers 37A to 37C for those axes.

The reference pulse generating means 34 is comprised of a sequencer, a personal computer and so on, and generates reference pulses of a predetermined cycle in a number corresponding to, for example, one cycle of a grinding operation. The pulse distributor 35 distributes the reference pulses to the various position change curve setting means 36A to 36C.

The position change curve setting means 36A to 36C store respective positions relative to the reference pulses in the form of position change curve a to c and output, for each pulse inputted, a position command corresponding to the number of the pulses inputted thereto. Accordingly, the position command includes a speed command. The position command which is outputted may be an analog output proportional to, for example, a voltage value or the like or a train of pulses.

Figure 2:
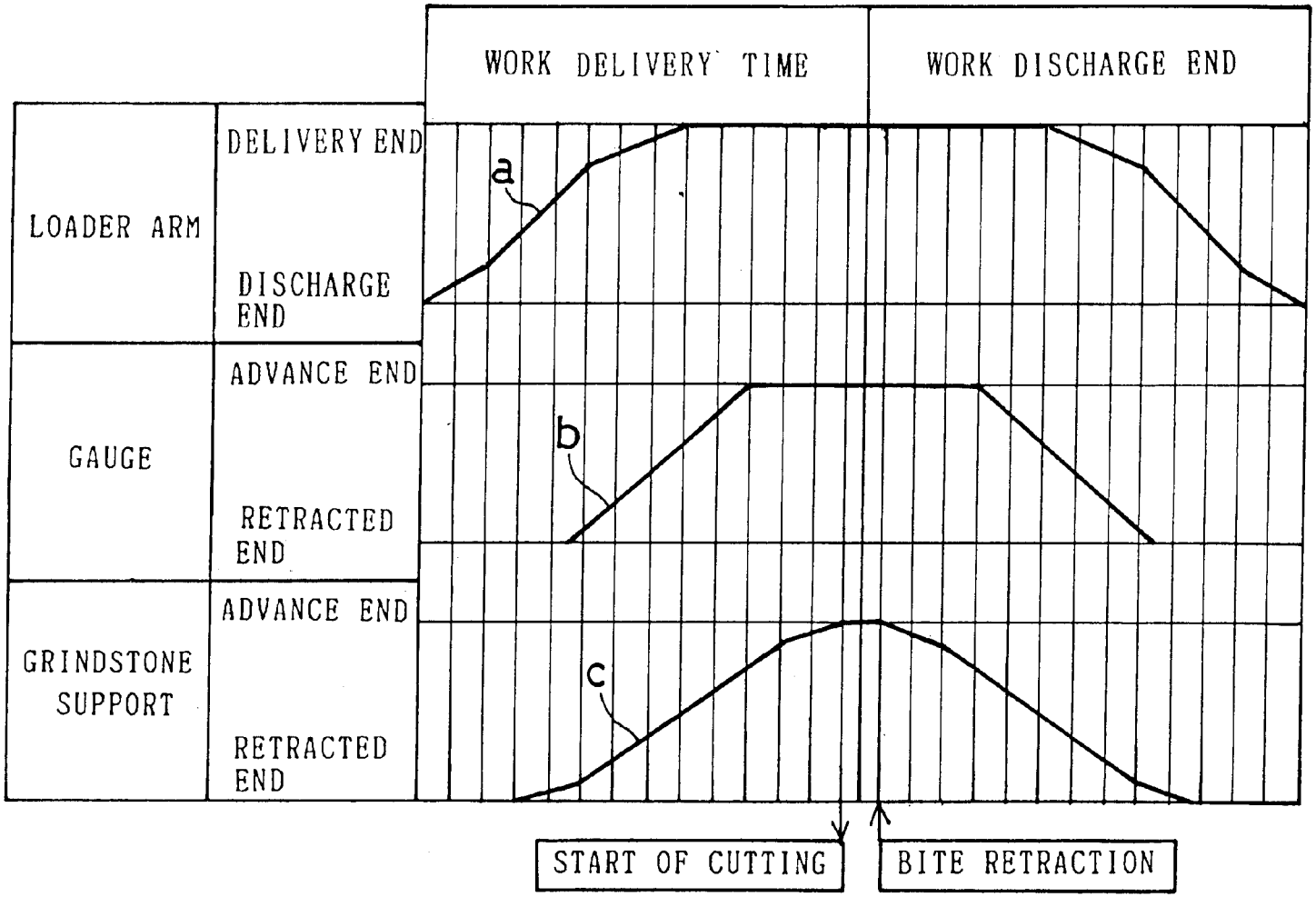
FIG. 2 is an explanatory diagram used to explain examples of curves showing changes in position in a position change curve setting means.

FIG. 2 illustrates a specific example of each of those position change curves a to c. According to the position change curves a to c shown in FIG. 2, prior to completion of delivery performed by the loader arm 9, advance of the in-process gauge 10 is initiated, and the grindstone support 25 is moved in unison with movement of the loader arm 9 and the in-process gauge 10 without being interfered by others. At the time of discharge of the work, the loader arm 9, the in-process gauge 10 and the grindstone support 4 perform respective operations reverse to those taking place during the delivery of the work. It is to be noted that the position change curve setting means 36A to 36C shown in FIG. 1B output respective position commands by returning to the initial position change curves a to c in response to receipt of the next succeeding pulse in the event that the reference pulse is not inputted for a predetermined length of time and/or a predetermined start signal is inputted.

The servo controllers 37A to 37C control the respective positions and speeds of the various servo motors 15, 18 and 13 in response to the associated position commands outputted from the corresponding position change curve setting means 36A to 36C and are made up of servo amplifiers and so on. Those servo controllers 37A to 37C performs a feed-back control of the position, the speed and the like by monitoring respective outputs from detectors (not shown) such as, for example, a pulse coder or the like, provided in the associated servo motors 15, 18 and 13.

Although in the position control device 31 shown in FIG. 1A, the motor 11 for driving the main shaft support 2 is controlled by the use of position change curve setting means (not shown), similar to the previously described position change curve setting means 36A to 36C, and servo controller, it is controlled by a reference pulse generating means different from the reference pulse generating means 34 shown in FIG. 1B. The reason that the drive motor 11 for the main shaft support 2 shown in FIG. 1A is controlled separately in this way is because the main shaft support 2 need be controlled highly accurately to accomplish a control of cutting performed by the grindstone 4*a*. However, the drive motor 11 for the main shaft support 2 may be controlled by the position change curve setting means distributed from the pulse distributor 35 shown in FIG. 11B.

Also, control of respective operations of the pusher 23 and the stopper 24 in the work exchange device 7 shown in FIG. 3A can be carried out by the use of position change curve setting means similar to those described hereinbefore.

The operation of the position control device 31 shown in FIG. 1B will now be described. The reference pulse generating means 34 generates synchronizing pulses, the number of which corresponds to one cycle of grinding operation, that is, a reference pulse. This reference pulse is distributed by the pulse distributor 35 to the various position change curve setting means 36A to 36C which subsequently output respective position commands of predetermined position change curves a to c to the servo controllers 37A to 37C of the motors 15, 18 and 13 for the various devices. Accordingly, if the position change curves a to c are set to desired curves as shown in FIG. 2 and other figures, a high-speed synchronized control can easily be accomplished. In other words, merely by preparing one kind of the reference pulse by the use of the reference pulse generating means 34, a synchronized control of multi-axes is possible and a high-speed synchronized multi-axis control can be accomplished easily.

As hereinabove described, this grinding machine is so configured that the waste of the time required to accomplish the work exchange in the work exchange device 7, such as discussed with reference to FIGS. 3A and 3B, can be eliminated and the compact electric motor is used for the drive motor 15 for the loader arm 9 thereof and is controlled on a feed-back control scheme by the servo controller 37A shown in FIG. 1B. Accordingly, it is possible to minimize the delay in operation of the loader arm 9 shown in FIG. 1A. Similarly, the compact electric motor is employed for each of the respective drive sources of the in-process gauge 10 and the grindstone support 25 in combination with the associated reduction gear unit to thereby achieve a high-speed response. If such a multi-axis control is intended to be accomplished by the use of a multi-axis NC device, a relative high cost would be incurred in securing the NC equipment and development of a control program. However, in the present invention, since the position change curve setting means 37A to 37C which serve as the so-called electronic cams are employed to allow respective operations of the various component parts to be executed in an overlapping relation with each other in sequence, and, therefore, synchronization of various operation and reduction in cost can be accomplished with a simplified construction.

Also, since the use has been made of the electric motor for each of the work exchange device, the retracting device for the grindstone, and the gauge retracting device, and die use has also been made of the reference pulse generating means and the position change curve setting means for outputting the respective position commands according to the predetermined position change curves in response to the reference pulse inputted thereto, not only can the multi-axis synchronized operation can be accomplished with the single-axis control, simple and less costly, with no need to use the multi-axis NC device, but the possible delay in each of the drive system and the control system can also be eliminated to accomplish a high-speed feature.

Since the work exchange device, the retracting device for the grindstone and the gauge retracting device are driven by the associated electric servo motors through the corresponding reduction gear units, a compact motor can be used for the electric motors and, therefore, with the response further improved, confirmation accomplished by switches and/or sensors for the various operations can be eliminated to thereby accomplish a high-speed feature. For this reason, in the grinding machine of a type in which a plurality of works, each being of a kind requiring a relatively short time of processing, are processed, it brings about considerable practical effects.

Moreover, since the pusher starts its pushing operation to push the unprocessed work while the loader arm of the work exchange device is being returned from the processing station towards the receiving and discharge position and the unprocessed work pushes the processed work within the pocket of the loader arm to cause the unprocessed work to be pushed into the pocket, a possible waste of the time required to accomplish the work exchange can advantageously be minimized.

Hereinafter, the grinding control for accomplishing the cutting according to the illustrated embodiment of the present invention will be described with reference to FIG. 1A and FIGS. 10 to 17.

The work W shown in FIG. 1A is an outer race of a ball-and-roller bearing such as, for example, a ball bearing and is rotatably supported on the work rotary support device 6 including shoes 6*a* and 6*b* (FIGS. 15A and 15B) for the lower and side faces of the work and is driven angularly together with the main shaft 3 while attracted by the driving plate 116 (FIG. 15B) having an electromagnet at a front end of the main shaft 3. The grindstone 4*a* is positioned within the work W and performs a cutting in a horizontal direction of the work while being rotated. The processing dimension of the work W is captured by the gauge contacts (detector element support arms) 10*a* (FIGS. 15A and 15B) within the work W and is measured by the in-process gauge 10. The processing force (the grinding force) is measured by a grinding power meter 134 (FIG. 10) of the grindstone drive motor 4 (FIGS. 1A and 10) and a deflection sensor 119 (FIGS. 15A and 15B) for a grindstone shaft 109*a*.

Figure 10:
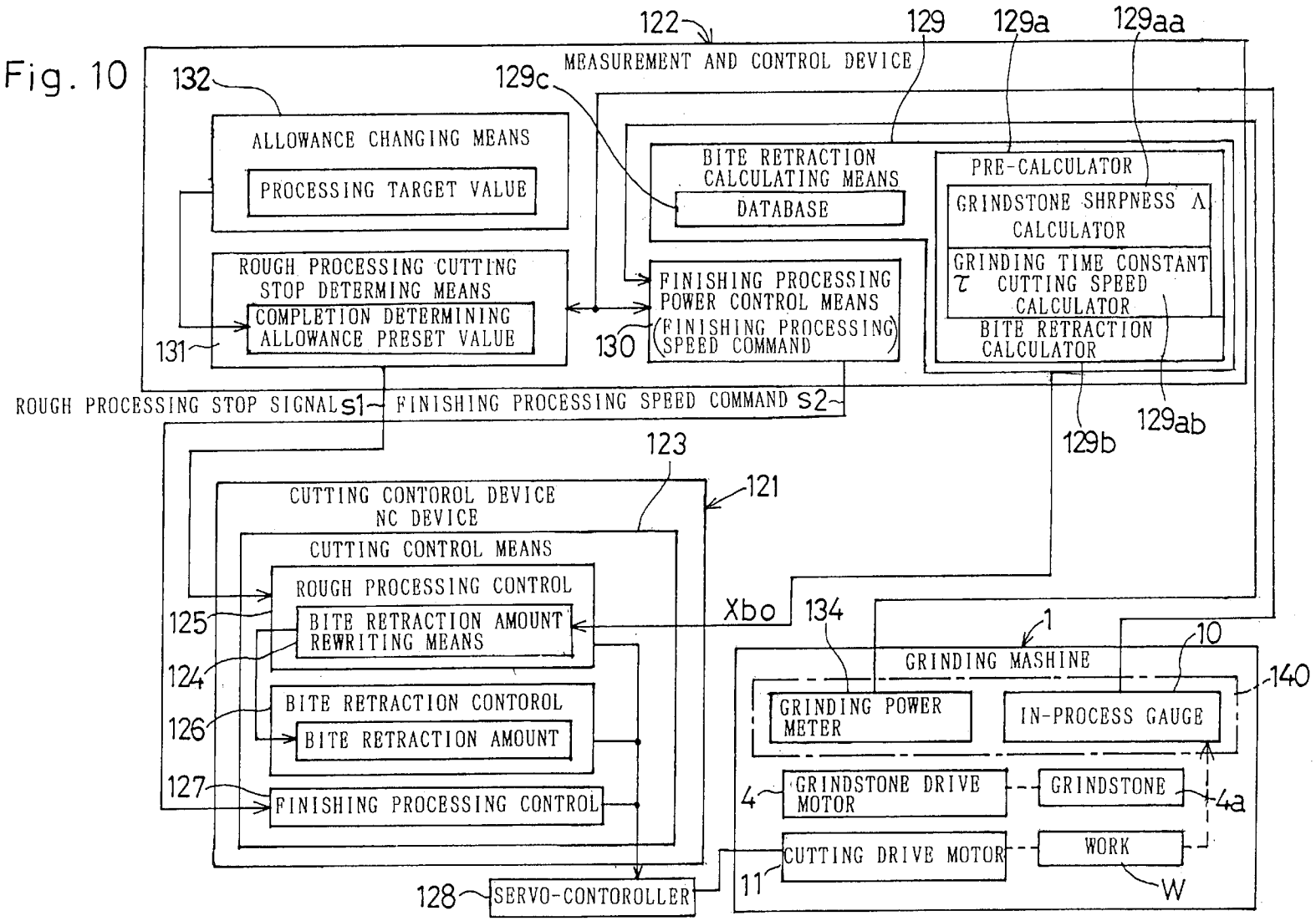
FIG. 10 is an explanatory diagram of a conceptual structure of a grinder control device used in the grinding machine according to one preferred embodiment of the present invention.

The control panel 30 is used to control the whole of the grinding machine 1, and a grinding control device portion of the control panel 30 which performs a cutting control is shown in FIG. 10 in a conceptual representation. This grinding control device comprises a cutting control device 121 in the form of a computer-aided NC device, a measurement and control device 122 in the form of a different computer which serves as a high-end control means for the cutting control device 121.

In describing the grinding control device, the summary thereof will first be described, followed by description of individual component parts thereof. The grinding control device performs a grinding process by carrying out a bite retraction after a rough grinding process as shown by a processing process shown in FIGS. 13 and 14 and comprises a measurement and control device 122 including a bite retraction calculating means 129 for calculating a proper amount Xbo of bite retraction during the rough grinding process. Also, to accomplish a high-speed response of the bite retraction, the cutting control device 121 is provided with a bite retraction amount rewriting means 124 for monitoring an external input of the amount of the bite retraction during the rough grinding process to rewrite a preset amount of the bite retraction. It is to be noted that according to the prior art standard method of setting the amount of the bite retraction, the cycle of the finishing process tends to become unstable due to an reason of instability such as, for example, change in speed of the finishing processing, change in grindstone sharpness and so on. Accordingly, in the illustrated embodiment, the device has been designed in which a method of calculating the amount of the bite retraction during the rough processing is employed and in which a high-response control can be accomplished with the amount of the bite retraction so calculated.

The measurement and control device 122 is provided with, as a high-speed processing means for accomplishing a high-speed processing to reduce the time of the finishing process to a target time while securing a processing accuracy, a finishing processing power control means 130, an allowance changing means 132 for changing the allowance in correspondence with the amount of delay in time, and a rough processing cutting stop determining means 131. The finishing processing power control means 130 is a means for linearly lowering the power P(t) during the finishing process as shown by a straight portion Pt4 in FIG. 14. The allowance changing means 132 is operable to change a preset value of the finishing allowance g1, with which determination as to completion of the rough processing in correspondence with the amount of difference between the target value of the time required to accomplish the finishing process and the actual time required to complete the finishing process. The rough processing cutting stop determining means 131 is a means for outputting a rough processing stop signal s1 to the cutting control device 121 when the processing dimension attains the completion determining finishing allowance g1 which is the preset value described above.

The bite retraction calculating means 129 and the finishing processing power control means 130 make use of the grindstone sharpness Λ and the grinding time constant τ as will be described later, and the bite retraction calculating means 129 includes a pre-calculating portion 129*a*, a bite retraction amount calculating portion 129*b* and a database portion 129*c*. The pre-calculating portion 129*a* includes a calculating portion 129*aa* for calculating the grindstone sharpeness Λ, a calculating portion 129*ab* for calculating the grinding time constant τ and the cutting speed. The finishing processing power control means 130 and the allowance changing means 132 share with the pre-calculating portion and the database 129*c* of the bite retraction calculating means 129, or includes a unique means for calculating the grindstone sharpness Λ and the grinding time constant τ and a unique database.

Figure 12:
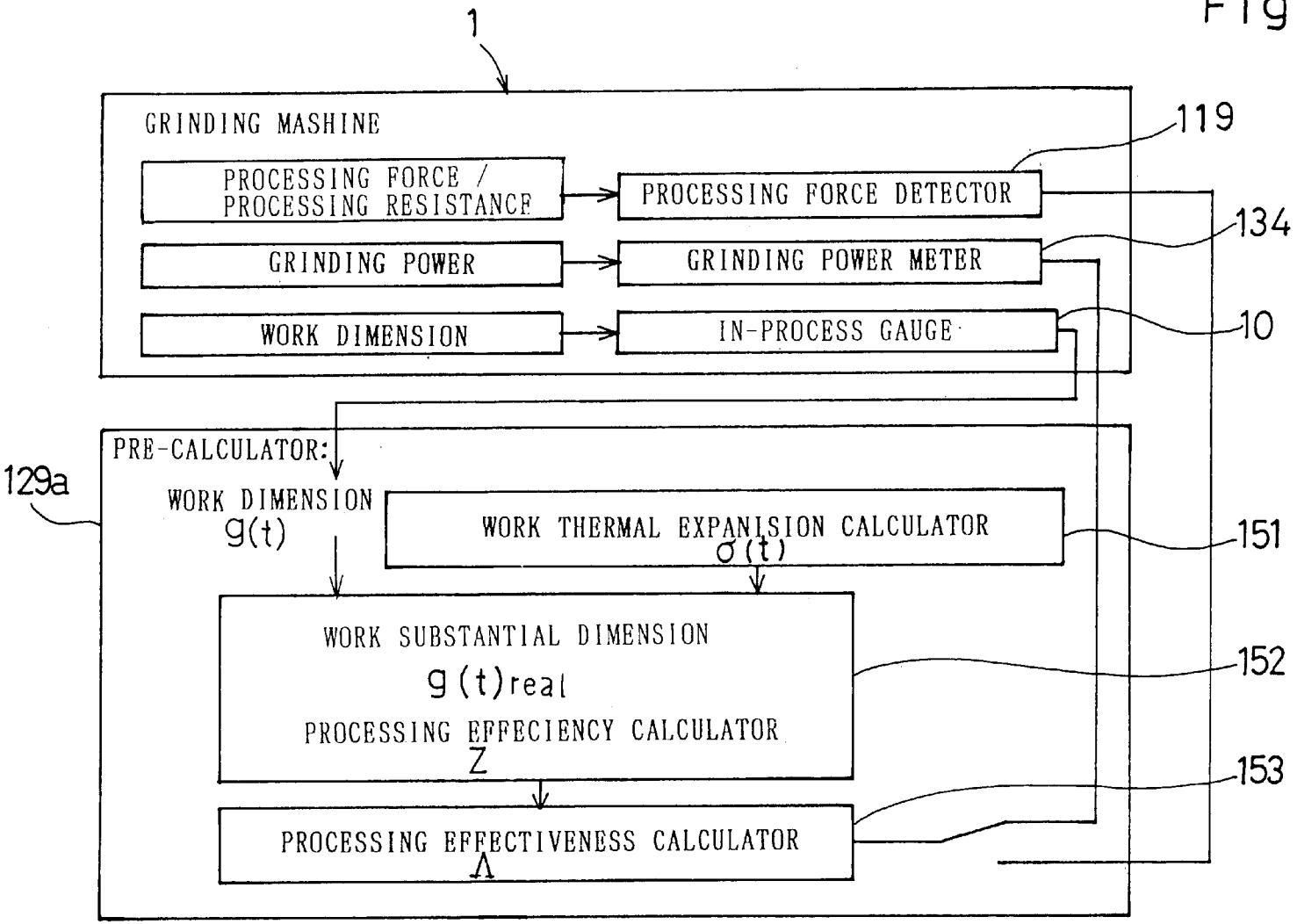
FIG. 12 is an explanatory diagram of a conceptual structure of a portion of the grinder control device, which calculates the grindstone sharpness (the processing efficiency), in the grinding machine according to one preferred embodiment of the present invention.

FIG. 12 illustrates the details of the grindstone sharpness calculating portion 129*aa* shown in FIG. 10, and this calculating portion 129*aa* is so designed as to calculate the accurate grindstone sharpness Λ in which compensation has been made for a thermal expansion. In other words, the grindstone sharpness Λ is calculated by dividing the processing force by the processing efficiency, that is, Λ=(Processing Force)/(Processing Efficiency), and the processing force is represented by the value of the grinding power or the grinding force. The processing efficiency is a value represented by the product of the amount of change per unitary time of the processing dimension times the process circumference. In such case, for the value of the processing dimension, a work real processing dimension in which the processing dimension of the work obtained by the in-process gauge 10 has been compensated for the amount of thermal expansion of the work is employed, and the amount of the thermal expansion of the work is calculated by the work thermal expansion measuring portion 151 in reference to the grinding power. Also, the amount of thermal expansion of the work is calculated using the quantity of heat entering the work W and the quantity of heat dissipating from the work. The processing efficiency Z is calculated by a processing efficiency calculating portion 152 and the grindstone sharpeness (the processing efficiency) Λ is calculated by a processing efficiency calculating portion 153.

According to this, the amount of thermal expansion of the work being processed can be accurately calculated on a real-time basis and the actual processing efficiency can be obtained by correcting the in-process gauge signal. The details thereof will now be described.

The work temperature θ(t) being subjected to the grinding process can be expressed by the following equation.

$$d\theta(t)/dt=\alpha\cdot P(t)-\beta\cdot\theta(t)$$

wherein α represents a heat inflow constant, β represents a heat outflow constant, P(t) represents the grinding power and θ(t) represents the work temperature.

Thus, it is possible to calculate the work temperature θ(t) according to the above equation by measuring the grinding power during the processing. From this work temperature, the thermal expansion δ(t) of the work can be obtained by multiplying the coefficient of thermal expansion of the work times the processing diameter times θ(t), that is;

$$\delta(t)=(\text{Work Thermal Expansion Coefficient})\times\text{Processing Diameter}\times\theta(t)$$

and, therefore, the real dimension $g(t)_{real}$ can be determined by subtracting δ(t) from the work dimension g(t) during the processing measured by the in-process gauge, that is:

$$g(t)_{real}=g(t)-\delta(t)$$

The processing efficiency Z is determined by the following equation:

$$Z=\pi\times D\times(dg(t)_{real}/dt)$$

and, therefore, the grindstone sharpness (the processing efficiency) Λ will be as follows as a function of the grinding power:

$$\Lambda=P(t)/Z$$

The orthogonal grinding force Fn will be:

$$\Lambda=Fn/Z$$

Thus, by correcting the thermal expansion of the work, evaluation of the grindstone sharpness (the processing efficiency) Λ will be done accurately and can be used as an effective parameter for the evaluation and control of the processing process.

It is to be noted that as regards the method of calculating the amount of thermal expansion of the work by the use of the grinding power during the grinding, the heat inflow constant and the heat outflow constant, reference may be made to a gauge zero-point correcting method in an automatic fixed dimension grinding process disclosed in the Japanese Patent Application No. 3-219728 applied for patent by the assignee of the present invention, the disclosure of which is herein incorporated by reference.

According to the grindstone sharpness calculation shown in FIG. 12, as the work processing dimension used to calculate the grindstone sharpness, the real processing dimension obtained by compensating the work processing dimension, obtained by the in-process gauge, for the amount of thermal expansion of the work is used and, since the amount of thermal expansion of the work is calculated from the grinding power, a change in cutting sharpness of the grindstone resulting from wear of the grindstone can be accurately evaluated during the processing, wherefore the cutting control can be carried out accurately to accomplish a high-speed processing while the accuracy is secured.

Since the calculation of the amount of thermal expansion of the work is carried out from the work temperature θ(t) with due regard paid to both of the inflow and the outflow of heat relative to the work, the cutting sharpness can further accurately be calculated to improve the processing accuracy.

Also, since the grindstone sharpness Λ is determined during the rough grinding process and the value of the grindstone sharpness obtained in the manner described above is used for the cutting control subsequent to completion of the rough grinding process, the cutting control for the finishing process can be stably carried out freely by the utilization of the accurate value of the grindstone sharpness to thereby realize a high-speed processing.

Referring to FIG. 10, the cutting control device 121 which may comprise a NC device is provided with the cutting control means 123 and the bite retraction amount rewriting means 124. The cutting control means 123 is a means for numerically controlling the cutting so as to perform a bite retraction in a preset quantity of bite retraction upon completion of the rough grinding process and to subsequently perform the finishing grinding process and is comprised of a rough processing control portion 125, a bite retraction control means 126 and a finishing process control portion 127. Each control portion 125, 126 and 127 performs a cutting control during a rough processing cycle, a bite retraction cycle and a finishing process cycle according to a speed command and a position command of the respective processing program, with a speed override being enabled. Outputting of the cutting command from each control portion 125, 126 and 127 is supplied to the cutting drive motor 11 through the servo controller 128.

Figure 11:
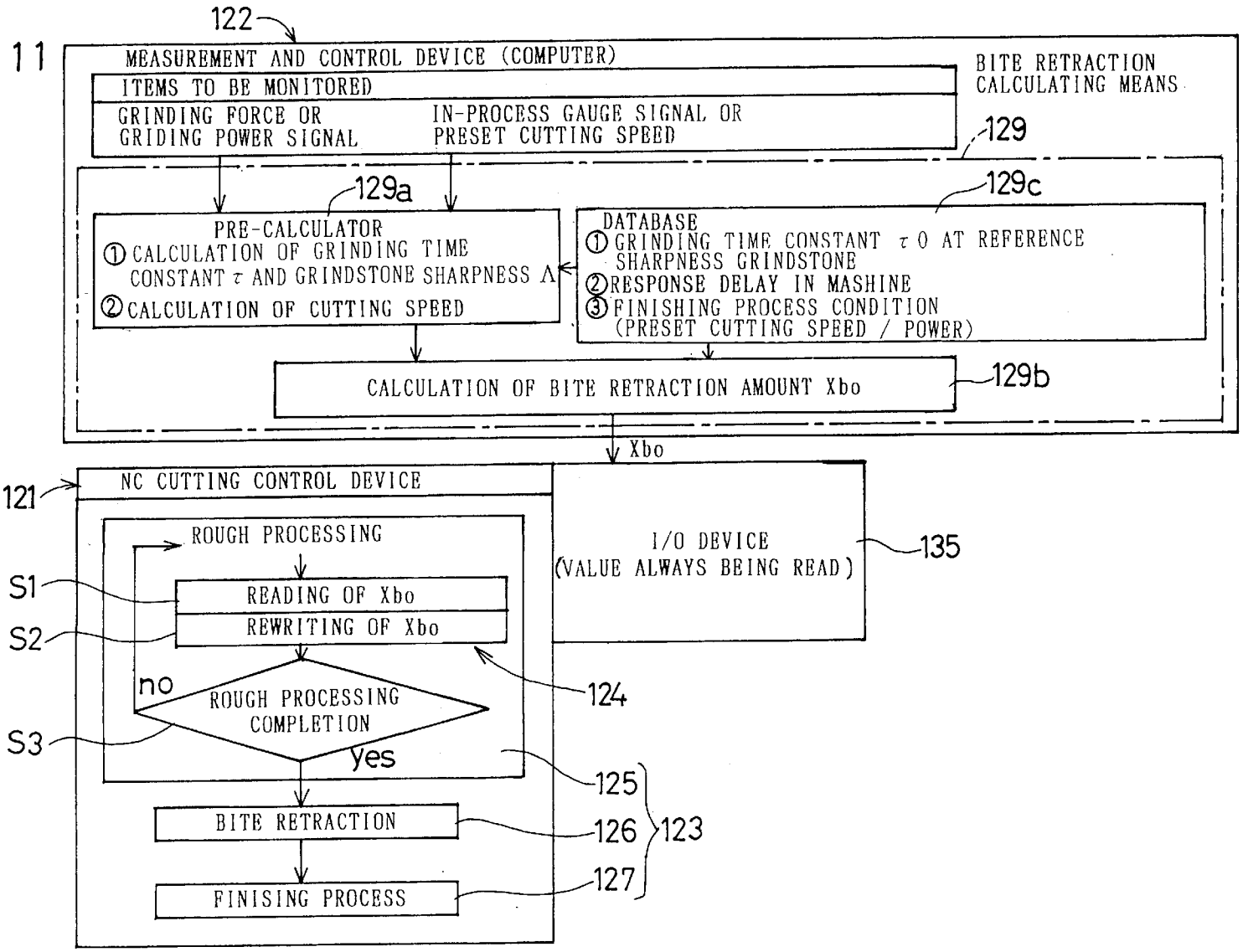
FIG. 11 is an explanatory diagram of a conceptual structure showing component parts of the grinder control device, which are associated with the control of the bite retraction, in the grinding machine according to one preferred embodiment of the present invention.

The bite retraction amount rewriting means 124 is a means for monitoring an external input of the amount of the bite retraction during the rough grinding process so that the preset amount of the bite retraction of the bite retraction control means can be rewritten into the external input value each time the external input value is changed, and is, as shown in FIG. 11, incorporated in a control cycle at the rough processing control portion 125.

FIG. 11 illustrates a conceptual structure showing only a portion of the grinding control device which is associated with the control of the bite retraction. As shown therein, the bite retraction amount rewriting means 124 is made up of a step S1 of reading the amount Xbo of the bite retraction which is an external input, a step S2 of rewriting the preset amount of the bite retraction of the bite retraction control portion 126 into the value of the bite retraction amount Xbo which has been read as described above, and a decision step S3 of returning to the reading step S1 until a completion signal of the rough processing can be obtained. An I/O device 135 reads at all times the amount Xbo of the bite retraction discharged from the metering and measuring device 122 and transfer it to the bite retraction amount rewriting means 124.

The pre-calculating portion 129*a* of the bite retraction amount calculating means 129 in the metering and measuring device 122 is a means for calculating the grindstone speed, the grinding time constant τ and the grindstone sharpness (the processing efficiency) Λ according to the equation as will be described later, using a data stored in the database 129*c* and the measured value of a predetermined monitoring item of the grinder 1. The bite retraction amount calculating portion 129*b* is a means for calculating the amount Xbo of the bite retraction according to the equation as will be described later, using a data stored in the database 129*c*, the grinding speed and the grinding time constant τ calculated by the pre-calculating portion 129*a* and for discharging it to the cutting control device 121. The grinder 1 is provided with the measuring means 140 including the in-process gauge 10 and the cutting power meter 134, and the measuring means 140 performs a measurement of the predetermined monitoring item. The database 129*c* comprises a means for storing therein the data necessary for the calculation performed by each calculating portion 129*a* and 129*b*, for example, the grinding time constant τ0 at the reference grindstone sharpness, a delay in response of the machine and the finishing process condition (the preset cutting speed, power and so on).

With respect to the processing process of the stricture described above, the bite retraction will be mainly described with reference to FIG. 13. When the cutting X1(t) is initiated, the processing of the work starts and the work dimension g(t) progressively changes. At this time, since the grinding deflection δ(t)=X1(t)−g(t), the deflection δ(t) progressively increases as well before it converges to a predetermined value.

In this way, when the in-process gauge 10 detects that the work dimension attains the completion determining finishing allowance g1, the measurement and control device 122 (FIGS. 10 and 11) commands the cutting control device 121 to change the cutting onto the bite retraction. However, before the cutting speed completely changes, a delay would occur in a quantity equal to the time t1 during which the rough grinding is carried out, and the time t2 during which stop takes place before the bite retraction assumes. Also, a delay corresponding to the time t3 will occur after the bite retraction is carried out, but before the finishing cutting is initiated. Nevertheless, even after termination of the grinding, there is a delay of time t5 subsequent to detection of the completed dimension g0 by the in-process gauge 10 and before termination of the cutting and, therefore, the finished dimension ga will be different from the completed dimension g0. Those delays t1 to t3 are fixed for a given machine and can be used as known values for calculation.

In the meantime, assuming that the rough grinding speed, the finishing grinding speed (which is a design value of the grinding cycle), the deflection at the time of termination of the rough grinding and the deflection at the time of finishing (which is also a design value of the grinding cycle) are expressed by Vr, Vf, δr and δf, respectively, the grinding allowance r1 and the amount of deflection δr at a timing t1 are:

r1=Vr×t1, and

δr=Vr×τ the allowance r2 and the amount of deflection δ2 at a timing t2 are:

r2=Vr×τ×(1−exp(−t2/τ)), and

δ2=δr×exp(−t2/τ)

the allowance r3 and the amount of deflection δ3 at a timing t3 are:

$$\delta 3 = (\delta r \times \exp(-t2/\tau) - Xbo) \times \exp(-t3/\tau) = \delta f, \quad \text{and}$$

$$r3 = \delta 2 - \delta 3 - Xbo$$

$$\therefore \quad Xbo = \delta r \times \exp(-t2/\tau) - \delta 3 \times (t3/\tau) = Vr \times \tau \times \exp(-t2/\tau) - \delta f \times \exp(t3/\tau).$$

δf is determined by the finishing process condition and can be calculated by the following equation.

δf=Vf×τ, where the finishing cutting speed Vf is set, or

δf=δr×Pf/Pr, where the finishing grinding power Pf is set.

As hereinbefore described, the bite retraction amount can be determined with due consideration paid to the delay in response of the mechanical system and the electric control system.

In this way, it is possible to calculate the bite retraction amount Xbo during the rough processing and an optimum cutting cycle can be configured by switching the bite retraction amount Xbo of the NC cutting control device 121 over to the preceding bite retraction.

The calculation and the setting of the bite retraction amount Xbo with the use of a user macro program or the like as a processing program to be executed by the cutting control device 121 comprising the NC device. In such case, the delay in responding to the cutting and its variation tend to increase and, therefore, it is not desirable where a number of works are successively processed.

In order to realize a high-speed response, in the cutting control device 121 comprising the NC device, it is preferred that the above discussed method of calculating the bite retraction amount Xbo and method of setting the bite retraction amount Xbo are incorporated in a numerical control system for executing the processing program and, in such case, the NC device will no longer be versatile and will become considerably expensive.

In contrast thereto, in the practice of the present invention, independent of the NC cutting control device 121, calculation of the processing conditions is carried out by the measurement and control device 122 comprising a separate computer device and the NC cutting control device 121 monitors the external input of the bite retraction at all times during a period in which the cutting of the rough grinding process is carried out and rewrites the preset bite retraction amount, wherefore the NC cutting control device 121 can have a versatility while accomplishing the high-speed response.

According to the cutting control shown in FIG. 10, since based on the measured value during the rough grinding process, the bite retraction amount at the time of completion of the rough grinding process is calculated to accomplish the bite retraction, setting of the optimum bite retraction amount capable of providing a stabilized grinding cycle can be accomplished even against unstable factors such as change in grindstone sharpness and/or change in cutting speed and finishing preset power.

Also, since the use has been made of the real processing dimension of the work which corresponds to the processing dimension of the work obtained from the in-process gauge has been compensated for the amount of thermal expansion of the work, as a value of the processing dimension used for the calculation of the grindstone sharpness used in calculating the bite retraction amount, the accurate grindstone sharpness can be calculated and, therefore, a further accurate setting of the proper bite retraction amount is possible.

Moreover, not only can the bite retraction amount be determined with due regards paid to the delay in response of the mechanical or the electric control system, but the accurate processing can be accomplished with no processing efficiency lowered.

Yet, it is comprised of the cutting control device 121 and the measurement and control device 122, and since the cutting control device 121 monitors the external input of the bite retraction amount at all times during the period in which the rough grinding process is carried out and rewrites the preset bite retraction amount, the bite retraction can be accomplished with the delay in response of the control system minimized. Also, since the cutting control device for performing the numerical control and the measurement and control device for calculating the bite retraction amount which is one of the processing conditions are provided independently from each other, each device may be of a simple structure having a high versatility.

The control of the finishing grinding process will now be described. A grinding control method for this finishing processing is a method for controlling the grinding process time to a target value and for executing a processing resistance control for stabilizing the processing accuracy even though the allowance and the grindstone sharpness (the processing efficiency) change.

In the first place, problems associated with the standard finishing process will be described, and the finishing grinding process control method according to this embodiment of the present invention will then be described.

Figure 13:
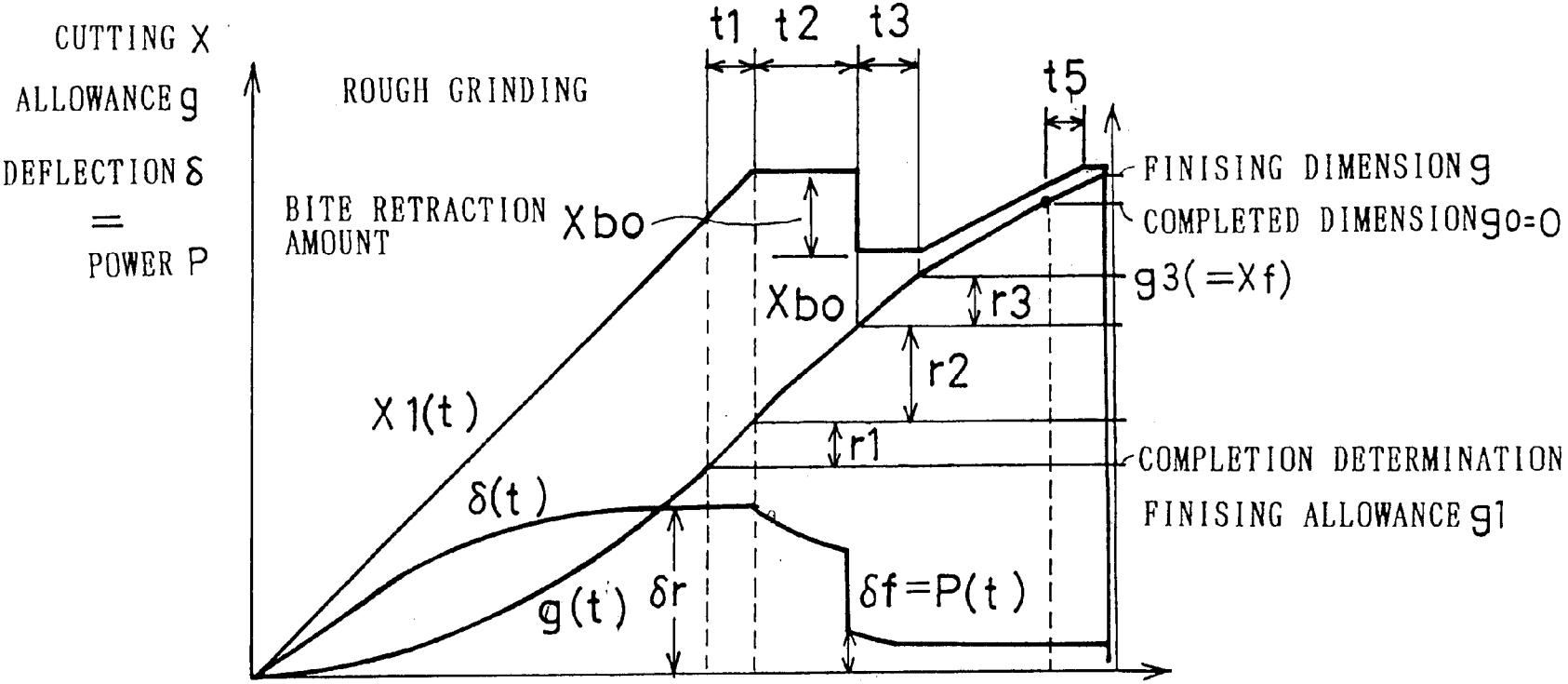
FIG. 13 is an explanatory diagram showing a processing process including the bite retraction.

Referring to FIG. 13, after the bite retraction has taken place in the manner described hereinbefore, the remaining allowance Xf(=g3) is as follows:

$$Xf=g1-r1-r2-r3$$

At the time, although in the order of $\mu$m, variation in amount of the bite retraction and errors in measurement by the in-process gauge are found. Even though the error is about 5 $\mu$m, variation of the processing time in the order of 1 sec. may result in if the finishing cutting speed is 5 $\mu$m/sec. This brings about a difficulty in management of the processing site and also in standardization of the processing conditions. If the delay in cutting is large and the finishing allowance g1 is reduced, it may occur that the finishing process cannot be executed.

In the practice of the grinding job hitherto done, those inconveniences have been counteracted by increasing the finishing allowance and, on the other hand, setting the finishing cutting speed to a higher value.

Also, since a delay in cutting may occur at the time of termination of the finishing process, the processing accuracy may be deteriorated if the processing resistance is high and/or if the work processing speed is high. Hitherto, a so-called spark-out grinding has been performed in which the cutting is stopped to maintain the processing accuracy. This tends to being about an unnecessary increase of the processing time.

Accordingly, in the illustrated embodiment of the present invention, in order to render the processing time to be constant by measuring the remaining allowance left after the bite retraction, and also in order to increase the preciseness of the work, a control is carried to bring the processing resistance at the termination of the finishing process to a lower value. In other words, in the illustrated embodiment, cutting is carried out by measuring the remaining allowance for the finishing grinding of the work prior to the start of the finishing cutting and by determining an optimum finishing cutting pattern.

As the previously discussed problems make it clear, with the presently used grinding machine variation in finishing allowance necessarily occur at the time of start of the finishing process and, therefore, a relatively large allowance for the finishing process is required. In order to remove the large finishing allowance in a short time and to increase the processing accuracy at the time of termination of the finishing process, it is necessary to render the processing resistance to be a value as small as possible, say, zero. Therefore, the processing condition is set as shown in FIG. 14.

Figure 14:
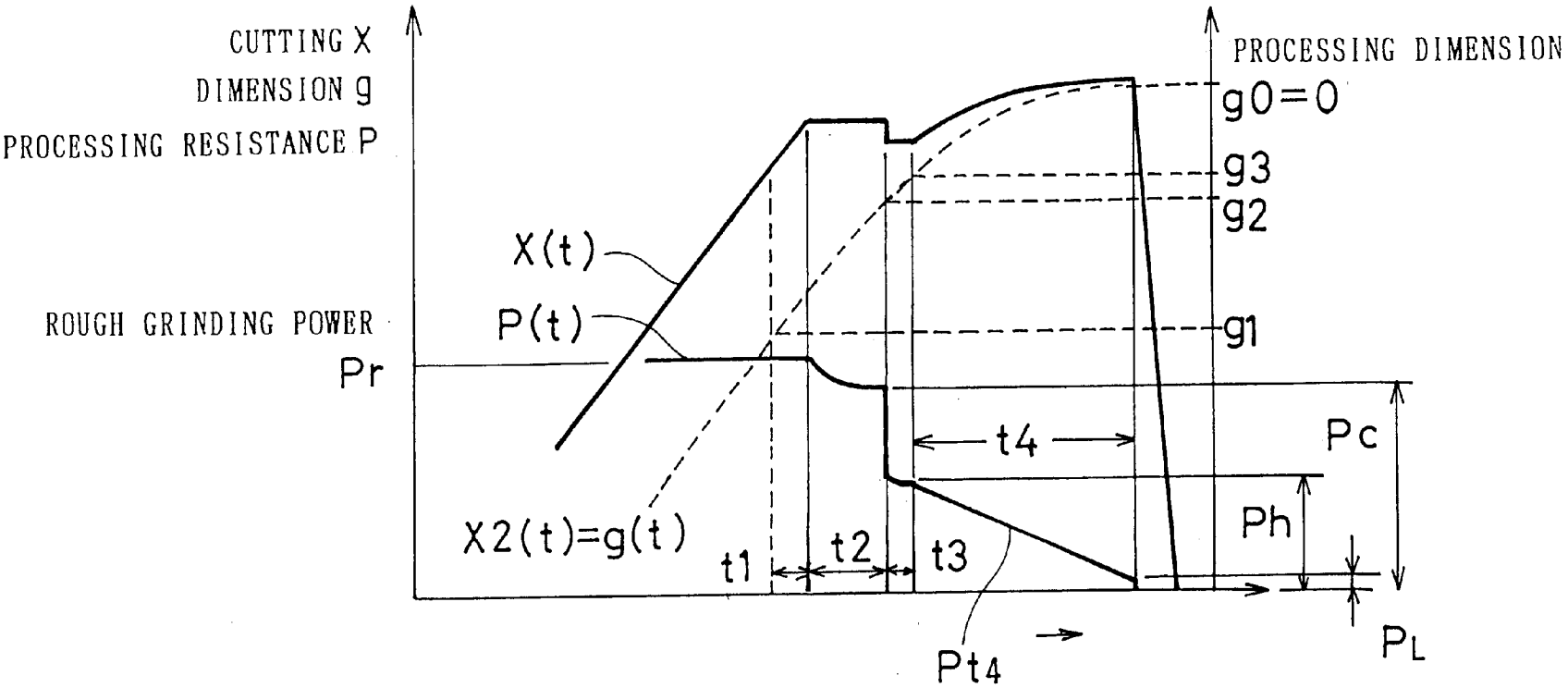
FIG. 14 is an explanatory diagram showing the finishing grinding.
Figures 15A, 15B:
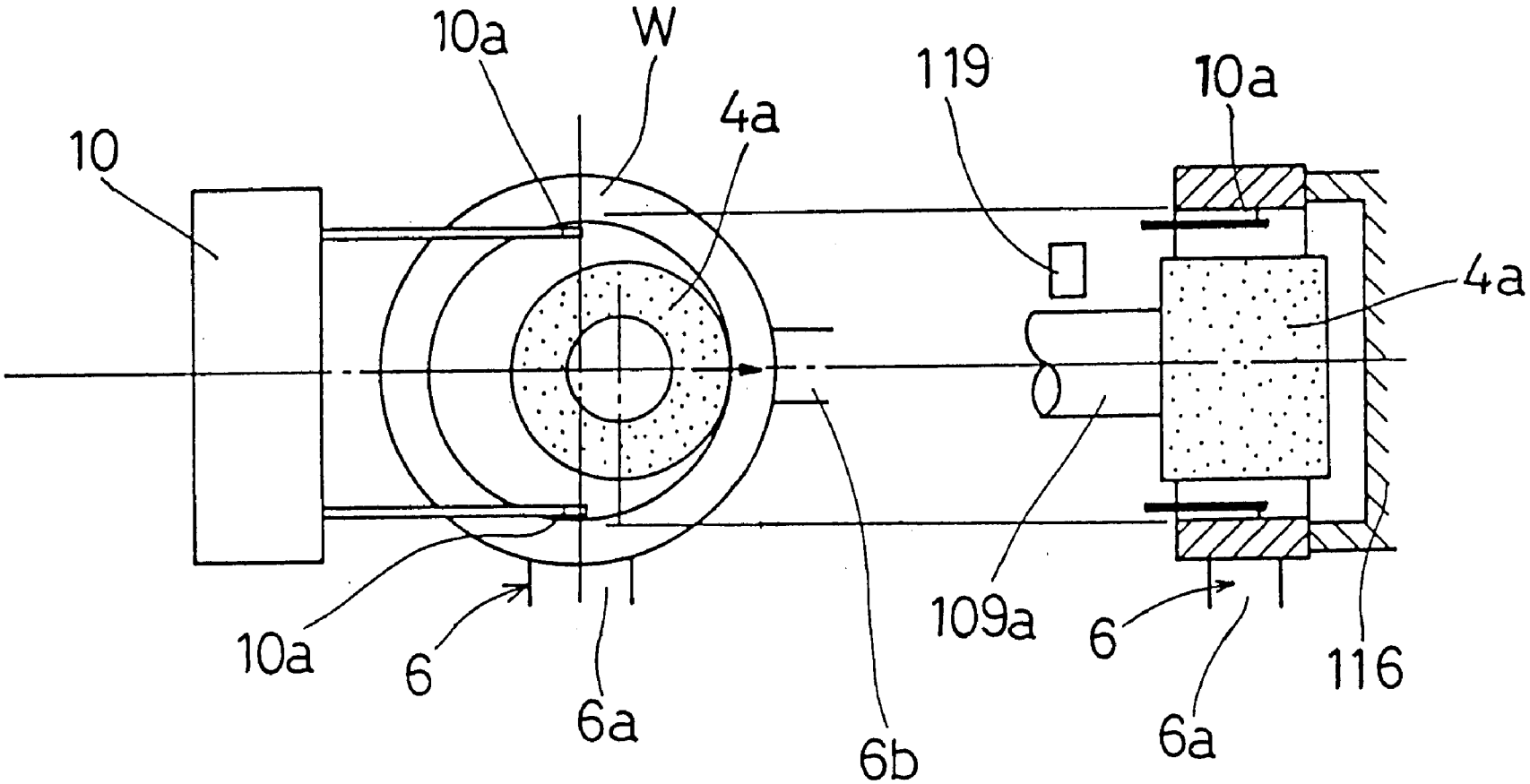
FIG. 15A is a front elevational view showing the relation between the grindstone and the in-process gauge.
FIG. 15B is a sectional view thereof.
Figure 16:
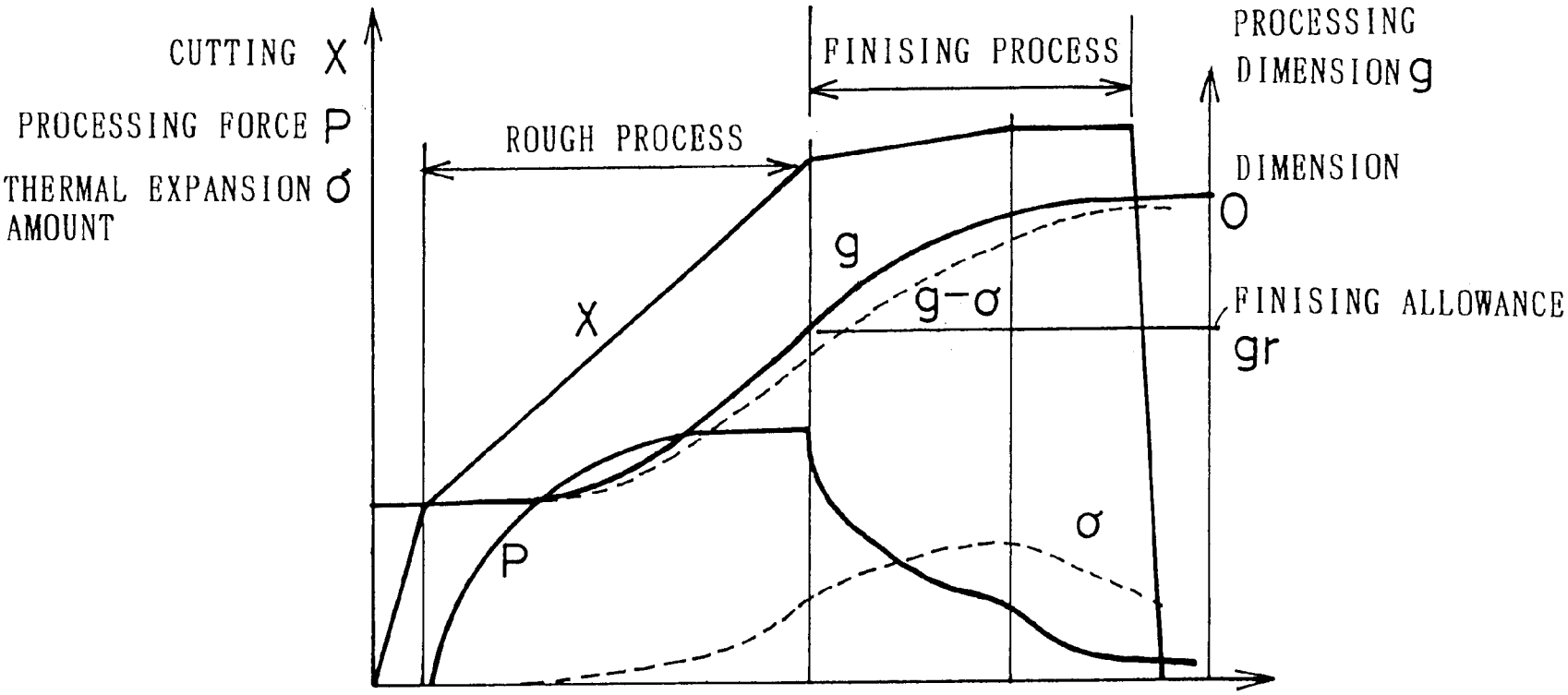
FIG. 16 is an explanatory diagram of the grinding process exhibiting a thermal expansion.
Figure 17:
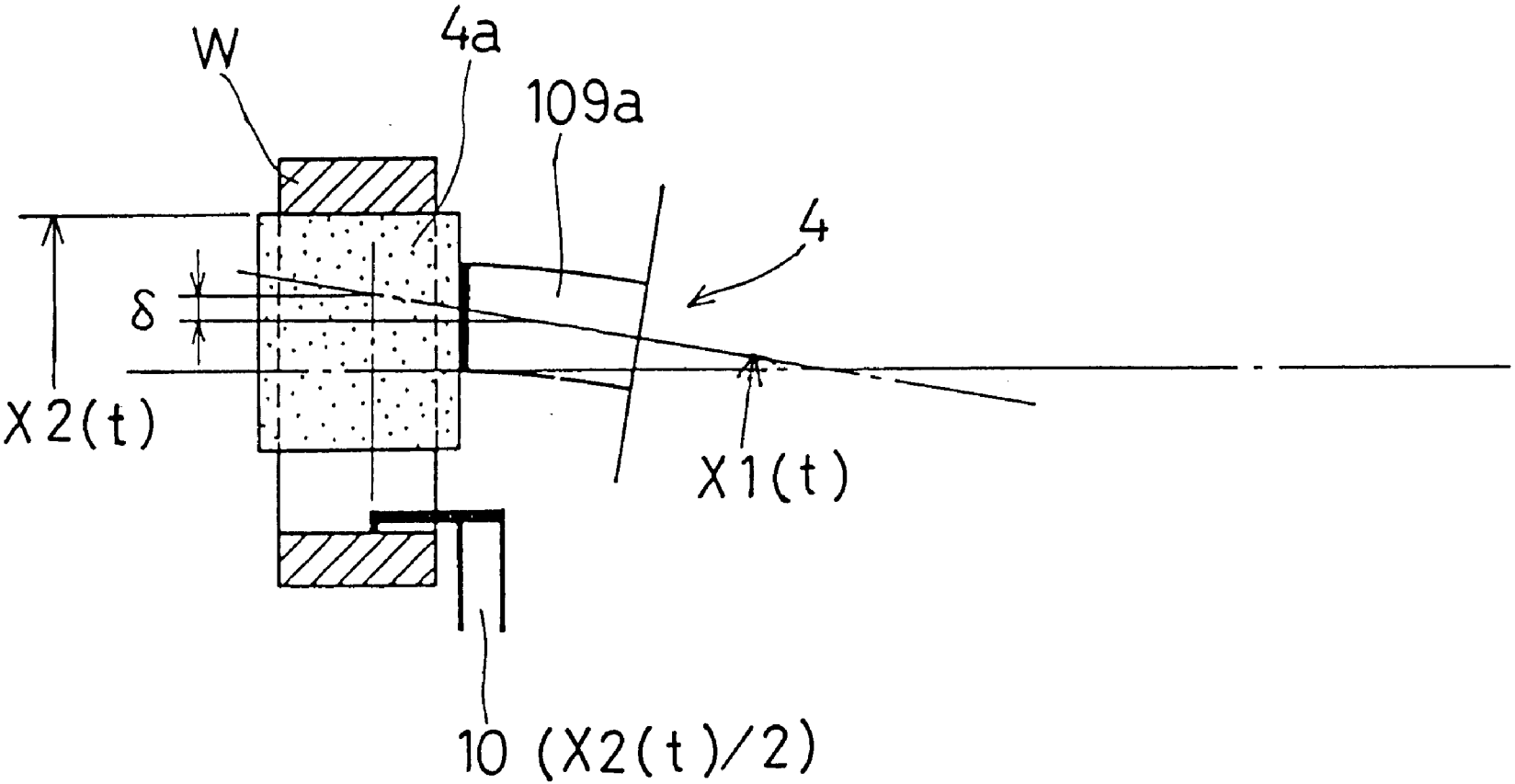
FIG. 17 is an explanatory diagram in which the deflection occurring during the grinding process is exaggerated.
Figures 18A, 18B:
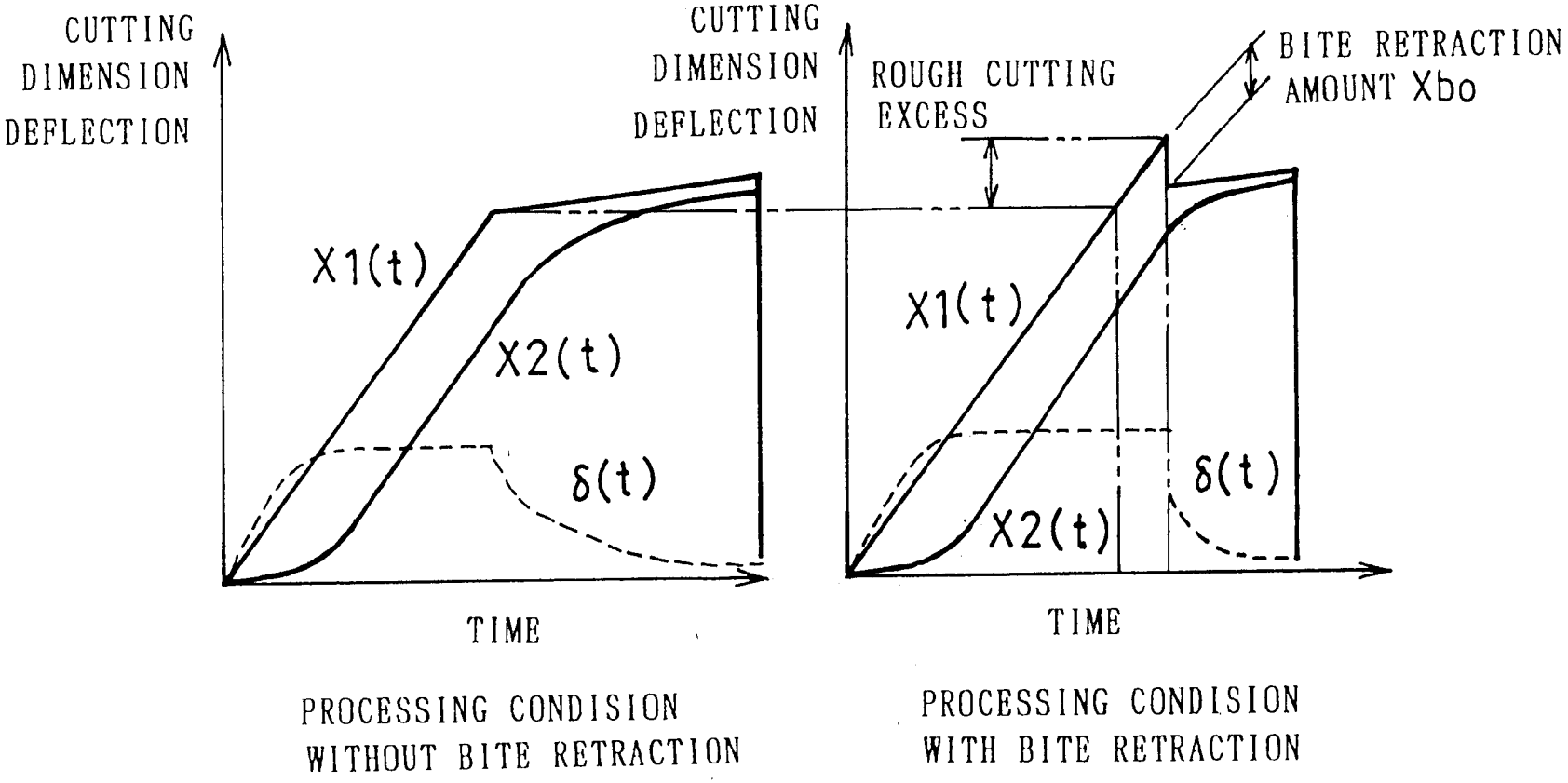
FIGS. 18A and 18B are explanatory diagrams of the grinding process in which the presence and absence of the bite retraction are shown by comparison.

As shown in FIG. 14, when the rough processing is carried out using the power Pr for the rough processing and the cutting speed Vr(=dX2(t)/dt), the rough processing will be controlled so that the rough processing will terminate with an in-process gauge signal g(t)=g1 and the cycle will change from the bite retraction onto the finishing cutting. Even though the gauge signal of g(t)=g1 is generated, there are delays t1, t2 and t3 and, therefore, the finishing processing will not follow immediately. Also, due to variation in measurement and control, the finishing allowance g3 is also subject to variation. A condition will also occur in which the finishing processing will not take place because of the finishing allowance g3 being less than the processing dimension g0.

Therefore, the finishing process controls the cutting so that the processing power may decrease linearly from the processing power Ph at the time of start of the finishing process down to the processing power P1 at the final stage of the finishing processing.

The cutting in which the processing power (the cutting power) during the finishing grinding is linearly lowered from Ph down to P1 will be as follows: The equation of the basic characteristic of the grinding system;

$$dX2(t)/dt=(X1(t)-X2(t))/\tau$$

and if dP(t)/dt=(Ph−P1)/t4=fixed, $$d^2X2(t)/d^2t=k\times(Ph-P1)/t4.$$

Solving the equation using the initial condition t=0, X1(0)=Xr, and dX2(t)/dt=Vr, will result in:

$$X1(t)=\{(P1-Ph)/(2k\cdot t4)\}\times t^2+\{Vr+(P1-Ph)\pi/(k\cdot t4)\}\times t+Xr$$

$$X2(t)=\{(P1-Ph)/(2k\cdot t4)\}\times t^2+Vr\times t+Xr-Vr\times\tau$$

Thus, it will readily be understood that the cutting is represented by a quadratic curve.

Also, the bite retraction amount Xbo will be expressed by the following equation as hereinbefore discussed:

$$Xbo=\delta r\times\exp(-t2/\tau)-\delta 3\times\exp(t3/\tau)$$

$$=Vr\times\tau\times\exp(-t2/\tau)-\delta f\times\tau\times\exp(t3/\tau).$$

The rough grinding completion dimension g1 is expressed as follows:

$$g1=Vr\times t1+(Vr-Vf)\times\tau-Xbo+\{(Ph+P1)/2k\}\times t4$$

In the illustrated embodiment, the value of the processing dimension g3 after the bite retraction is measured by the in-process gauge 10 and, by controlling the finishing cutting according to the following equation, the stabilized preciseness and the processing cycle are realized.

$$Vf(t)=\{(P1^2-Ph^2)/(k^2\times g3)\}\times(t2+t)+Ph/k$$

By carrying out the cutting in this way, it can be stabilized in a condition in which the processing resistance at the termination of the finishing processing is low. It is, however, to be noted that with progressive change of the grindstone sharpness (the processing efficiency) Λ, the value of k used in the above equations varies and, therefore, the processing time correspondingly changes. In order to avoid this, it is recommended to use a relatively large value for k when the grindstone sharpness Λ is deteriorated and to use a relatively small value for k when the grindstone sharpness Λ is improved. The grindstone sharpness Λ can be evaluated with high accuracy during the rough grinding process and, therefore, change of the value for k can easily be achieved.

As hereinabove discussed, a means for performing the control of the cutting by measuring the value of the processing dimension g3 and linearly lowering the processing power (the grinding power) from Ph down to P1 is the finishing processing power control means 130 included in the measurement and control device 122 shown in FIG. 10. A finishing processing speed command s2 issued by this means 130 is given in the form of a speed override command to the finishing processing control portion 127 of the cutting control device 121.

Where by controlling the cutting speed during the finishing grinding as shown by the foregoing equations, the processing time is reduced by performing the bite retraction after completion of the rough processing, it is possible to stabilize the processing accuracy and to render it to be an optimum cutting pattern, and stabilization of the processing time and that of the processing accuracy can be secured by controlling the time required for the finishing process to a desired value.

According to the finishing grinding shown in FIG. 14, since the method is such as to measure the finishing allowance after the rough grinding with the in-process gauge and then to linearly decrease the processing power or the processing force used from the start of the finishing grinding to the completion of the grinding at a gradient appropriate to the measured value of the finishing allowance, even though the allowance and/or the grindstone sharpness (the processing efficiency) change, not only can the grinding process time be controlled to the target value during execution of the high-speed grinding process, but the processing accuracy can also be stabilized.

According to the illustrated embodiment, it is further possible to control the finishing time to a desired time. This can readily be accomplished by giving an offset to the dimension g1 at the time of completion of the rough grinding.

According to this control, the set value g1 of the allowance for the finishing grinding with which determination of completion of the rough grinding is carried out is changed with a predetermined calculated value appropriate to the difference Δ sec between the target value Tsec of the finishing process time and the actual finishing process time Ta, with respect to the measured value g(t) of the processing dimension obtained from the in-process gauge 10 during the rough grinding. By way of example, where the actual finishing process time Ta is longer than the target value Tsec of the finishing process time, the quantity proportional to the difference Δ sec therebetween is to be subtracted from the preset value g1. More specifically, it is set to the value of g1 expressed by the following equation.

$$g1=Vr\times t1+(Vr-Vf)\times\tau-Xbo+\{(Ph+P1)/(2k)\}\times t4\pm\alpha\times\Delta$$

The constant α is chosen to be a value equal to or smaller than 1 in order to avoid hunting. The difference Δ is chosen to be a predetermined, statistically calculated value such as, for example, the finishing process time of the preceding processed work or an average finishing process time which had taken by a predetermined number of works previously processed.

The allowance changing means 132 shown in FIG. 10 is a means for measuring the difference Δ between the target value Tsec of the finishing process time and the actual finishing process time Ta and for changing the preset value g1 of the rough processing cutting stop determining means 131 according to the foregoing equation. The rough processing cutting stop determining means 131 is a means for monitoring the measured value g(t) of the processing dimension obtained from the in-process gauge 10 during the rough grinding and to supply a rough processing stop signal to the finishing process control portion 127 of the cutting control device 121 when the preset value g1 is attained.

In this way, the fact that the processing time can be converged within the desired processing time while securing the stabilized accuracy, by determining the preset value of the finishing grinding allowance g1, with which completion of the rough grinding process is determined, in proportion to the difference Δ in finishing process time as shown by the above equation, could have been demonstrated by an actual processing. Accordingly, it is possible to control the processing time to the desired target process time with the processing accuracy further stabilized.

According to the finishing grinding with the grinding machine shown in FIG. 10, since the preset value of the finishing grinding allowance with which completion of the rough grinding is determined relative to the measured value of the processing dimension obtained from the in-process gauge during the rough grinding is changed with a predetermined calculated value appropriate to the difference between the target value of the finishing process time and the actual finishing process time, even this is effective to control the grinding process time to the target value while securing the stabilized accuracy.

Where the grinding method or machine of the design wherein the processing power or the processing force is linearly lowered at the gradient appropriate to the measured value of the finishing allowance is employed in combination with the grinding method or machine of the type wherein the preset value of the finishing grinding allowance is changed with the predetermined calculated value appropriate to the difference between the target value of the finishing process time and the actual finishing process time, it is possible to further accurately control the grinding process time to the target value with the processing accuracy further stabilized during a high-speed grinding process.

Although the present invention has been filly described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A method of grinding a work comprising the steps of:

providing an in-process gauge;

grinding the work using a grinding element;

determining a grinding sharpness Λ of the grinding element during grinding of the work; and controlling a cutting of said work using the determined grinding sharpness Λ, wherein the step of determining the grinding sharpness Λ includes the step of measuring a processing dimension g(t) of the work using said in-process gauge.

2. The grinding method according to claim 1, wherein the step of determining the grinding sharpness includes the steps of:

determining a work temperature θ(t) of the work; and determining a real dimension $g(t)_{real}$ of the work using the work temperature θ(t) and the processing dimension g(t).

3. The grinding method according to claim 2, wherein the step of determining a real dimension $g(t)_{real}$ of the work includes the steps of:

determining a thermal expansion $\delta(t)$ of the work during processing; and calculating the real dimension of the work according to the formula $g(t)_{real}=g(t)-\delta(t)$.

4. The grinding method according to claim 3, wherein the work includes a bearing race having a processing diameter, the step of determining a thermal expansion $\delta(t)$ of the work including the step of:

calculating said thermal expansion of the work according to the formula $\delta(t)$=(work thermal expansion coefficient)×(processing diameter of the race)×$\theta(t)$.

5. The grinding method according to claim 2, the step of determining the grinding sharpness including the steps of:

calculating a processing efficiency Z according to the formula $Z=\pi\times D\times(dg(t)_{real}/dt)$, where D represents a processing diameter of the work;

determining an orthogonal grinding force Fn of the grinding element on the work; and calculating the grinding sharpness $\Lambda$ according to the formula $\Lambda=Fn/Z$.

6. The grinding method according to claim 2, wherein the step of determining the temperature $\theta(t)$ of the work includes the steps of:

providing a grinding power meter;

providing a grinding element drive motor; and measuring the grinding power provided to the drive motor using the power meter.

7. The grinding method according to claim 6, wherein the step of determining the work temperature includes the step of calculating $\theta(t)$ according to the formula $d\theta(t)/dt=\alpha\cdot P(t)-\beta\cdot\theta(t)$; wherein $\alpha$ represents a heat flow inflow constant, $\beta$ represents a heat outflow constant, and P(t) represents the grinding power.

8. The grinding method according to claim 1, wherein the step of measuring a processing dimension of the work includes the steps of:

selectively engaging the in-process gauge with the work; and separating the in-process gauge from the work.

9. The grinding method according to claim 1, wherein the step of determining the grinding sharpness includes the step of determining the grinding force exerted by the grinding element on the work.

10. A grinding method which comprises the steps of:

engaging a grinding element with a work during a grinding process;

determining a grinding sharpness $\Lambda$ of the grinding element which is represented by the ratio, or a reciprocal thereof, of a processing force exerted by the grinding element relative to a processing efficiency of the grinding process during the grinding process, said processing efficiency being represented by the product of the amount of change of a processing dimension of the work per unitary time times a processing circumference of the work, and said processing force being represented by a grinding force or a grinding power of the grinding element; and controlling a cutting of the work according to the grinding sharpness $\Lambda$ which has been determined;

wherein a real processing dimension of the work, which is the processing dimension of the work obtained from an in-process gauge which has been compensated for an amount of thermal expansion of the work during the grinding process, is used as a value of the processing dimension of the work, said amount of thermal expansion of the work being calculated from the grinding power.

11. The grinding method as claimed in claim 10, further comprising the steps of calculating a work temperature $\theta(t)$ using the equation $$d\theta(t)/dt=a\cdot P(t)-b\cdot\theta(t)$$

wherein a, b and P(t) represent a heat flow inflow constant, a heat outflow constant and the grinding power, respectively; and calculating the amount of thermal expansion of the work with the use of the calculated work temperature $\theta(t)$.

12. The grinding method as claimed in claim 10, wherein the grinding process includes a rough grinding process, the grinding sharpness $\Lambda$ being determined during the rough grinding process, and the determined value of grinding sharpness $\Lambda$ is used in calculation for the cutting control to be performed after completion of the rough grinding process.

13. A method of grinding a work comprising the steps of:

grinding the work using a grinding element;

determining a grinding sharpness $\Lambda$ of the grinding element during the grinding of the work; and controlling a cutting of said work utilizing the determined grinding shyness $\Lambda$, wherein the step of determining a grinding sharpness includes the steps of:

determining a processing efficiency of the grinding of the work;

determining a grinding force exerted by the grinding element on the work; and calculating a ratio of the processing efficiency to the grinding force.

14. The grinding method according to claim 13, wherein the step of determining the processing efficiency of the grinding of the work includes the steps of:

determining a processing dimension of the work;

determining a work temperature of the work; and calculating a real dimension of the work using the processing dimension and work temperature values.

15. The grinding method according to claim 14, wherein the step of determining a work temperature includes the step of determining a grinding power provided to a motor for rotating the grinding element during grinding.

16. The grinding method according to claim 14, wherein the step of determining the processing efficiency includes the step of calculating the processing efficiency as a product of the rate of change of the real dimension of the work and a processing circumference of the work.

* * * * *